US006546213B2

(12) United States Patent
Ito et al.

(10) Patent No.: US 6,546,213 B2
(45) Date of Patent: Apr. 8, 2003

(54) TONER CARTRIDGE AND IMAGE FORMING APPARATUS

(75) Inventors: Junichi Ito, Tokyo (JP); Toshimasa Shiobara, Tokyo (JP); Masanori Maekawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/935,764

(22) Filed: Aug. 24, 2001

(65) Prior Publication Data

US 2002/0028081 A1 Mar. 7, 2002

(30) Foreign Application Priority Data

Aug. 28, 2000 (JP) ..... 2000-257400

(51) Int. Cl.[7] ..... G03G 15/08
(52) U.S. Cl. ..... 399/27; 399/254
(58) Field of Search ..... 399/27, 254, 256, 399/261

(56) References Cited

FOREIGN PATENT DOCUMENTS

| | | | |
|---|---|---|---|
| JP | 2-236574 | * | 9/1990 |
| JP | 3-31878 | * | 2/1991 |
| JP | 5-127520 | * | 5/1993 |
| JP | 5-232806 | * | 9/1993 |
| JP | 6-167885 | * | 6/1994 |
| JP | 6-266229 | * | 9/1994 |
| JP | 8-44182 | * | 2/1996 |
| JP | 8-272200 | * | 10/1996 |
| JP | 11-38744 | * | 2/1999 |

* cited by examiner

*Primary Examiner*—Quana M. Grainger
(74) *Attorney, Agent, or Firm*—Rabin & Berdo, PC

(57) ABSTRACT

A toner cartridge detachably is attached to an image forming apparatus. The toner cartridge includes a toner chamber that holds toner therein and a toner-agitating mechanism that agitates the toner in the toner chamber. The mechanism includes a crank shaft that includes a first crank pin and a second crank pin, the crank shaft being rotatably supported in the toner chamber. A rod has a first end rotatably coupled to the second crank pin and a second end slidably inserted in a guide path provided above the toner chamber. The second end has a permanent magnet or a magnetic flux sensitive element attached thereto. The rod moves upward and downward when the crank shaft is driven in rotation. A detection mechanism on the image apparatus side detects the magnetic flux or the permanent magnet.

19 Claims, 23 Drawing Sheets

TONER CARTRIDGE AND IMAGE FORMING APPARATUS

BACKGROUND OF THE INVENTION

1. Field of the Invention

The present invention relates to an image forming apparatus such as an electrophotographic recording apparatus and a copying machine, and to a toner cartridge that is removably attached to an image forming apparatus.

2. Description of the Related Art

One conventional electrophotographic recording apparatus such as an electrophotographic color recording apparatus incorporates a plurality of image-forming apparatuses for toner images of different colors, aligned in a direction in which a print medium travels. Each image-forming apparatus includes a photoconductive drum on which an electrostatic latent image is formed, and a developing unit by which the electrostatic latent image is developed with toner into a toner image.

The developing unit includes a developing roller in pressure contact with the photoconductive drum and a toner-supplying roller which in turn is in contact with the developing roller. A toner cartridge holds toner therein and is attached to the developing unit. The toner cartridge has an opening through which the toner is discharged into the developing unit.

The developing unit has a toner agitator that is located immediately below the opening of the toner cartridge and agitates the toner to prevent toner clumping. The image-forming apparatus has a toner detector that detects an amount of remaining toner.

The aforementioned conventional toner cartridge discharges the toner therein over the toner agitator on the image-forming apparatus side. Therefore, the toner cartridge has to be mounted at a specific location relative to the image-forming apparatus. This is detrimental to miniaturization of the image-forming apparatus. In particular, the dimension in the direction of travel of the print medium is difficult to be made smaller.

SUMMARY OF THE INVENTION

An object of the present invention is to provide a toner cartridge having a remaining toner detecting mechanism that detects an amount of toner remaining in a toner chamber.

An object of the present invention is to provide a toner cartridge that can detect an amount of toner remaining in a toner chamber and an image forming apparatus that can indicates to a user when the toner chamber in the chamber is nearing exhaustion.

An object of the present invention is to provide a toner cartridge and an image-forming apparatus that can be miniaturized so that the dimension in the direction of travel of the print medium can be smaller.

A toner cartridge is attached to an image forming apparatus. The toner cartridge has an opening through which toner is discharged into a developing unit of the image forming apparatus. The toner cartridge includes:

a toner chamber that holds the toner therein; and a toner agitating mechanism that is driven to agitate the toner in the toner chamber, the toner agitating mechanism having an agitating member that agitates the toner in the toner chamber, and a coupling member that is coupled to the agitating member and displaced in accordance with a motion of the agitating member.

The coupling member has a first end and a second end, the first end being connected to a remaining-toner detecting element; and The agitating member has an agitating element that agitates the toner in the toner chamber and a transmitting element coupled to the second end of the coupling member, the transmitting element operating together with the agitating member to transmit the motion of the agitating member to the second end of the coupling member.

The toner agitating mechanism includes:

a crank shaft that includes a first crank pin that agitates the toner and a second crank pin that is formed in the crank shaft, the crank shaft being rotatably supported in the toner chamber;

wherein the coupling member has a first end rotatably coupled to the second crank pin and a second end slidably inserted in a guide path provided above the toner chamber, the second end having a remaining-toner detecting element provided thereto.

The remaining-toner detecting element may be a magnetic material.

The remaining-toner detecting element may be a permanent magnet.

A toner cartridge and an image forming apparatus are combined such that the toner cartridge is detachably attached to the image forming apparatus. The toner cartridge has an opening through which toner is discharged into a developing unit of the image forming apparatus. The toner cartridge includes a first mechanism having an agitating member that is driven to agitate the toner in the toner chamber. The first mechanism has an agitating member that is driven to agitate the toner in a toner chamber. The first mechanism included remaining toner detecting mechanism that detects an amount of toner remaining in the toner chamber. The image forming apparatus include a second mechanism that detects an operation of the remaining-toner detecting mechanism.

The remaining toner detecting mechanism includes:

a transmitting element formed in the first mechanism, the transmitting element operating together with the first mechanism; and a coupling member having a first end coupled to the transmitting element and a second end to which a remaining-toner detecting element is provided.

The second mechanism includes:

a sensor lever and a photosensor, the sensor lever operating in response to a movement of the coupling member to cause the photosensor to selectively become ON and OFF.

The sensor lever has one end thereof to which a magnetic flux-sensitive element is attached, the magnetic flux sensitive element opposing the remaining-toner detecting element at the second end of the rod.

The sensor lever has one end thereof to which a magnet is attached, the magnet opposing the remaining-toner detecting element at the second end of the coupling member.

The sensor lever includes a first lever and a second lever coupled to the first lever such that the second lever is pivotal relative to the first lever in an upward direction;

wherein the image forming apparatus is vertically movable between an up position and a down position;

wherein when the image forming apparatus is at the down position, the first lever and the second lever cooperate to detect the remaining-toner in the toner chamber; and wherein when the image forming apparatus is at the up position, the image forming apparatus pushes the second lever in the upward direction so that the second lever pivots relative to the first lever not to detect the remaining-toner in the toner chamber.

The second mechanism includes a Hall effect element.

The Hall effect element is resiliently urged against a wall that separates the Hall effect element from one end of the remaining toner detecting mechanism. The toner cartridge is vertically movable between an up position and a down position when the image forming apparatus moves. When the image forming apparatus moves to the down position, the Hall effect element is resiliently extended in a downward direction to detect the remaining-toner in the toner chamber. When the image forming apparatus moves to the up position, the Hall effect element is resiliently retracted in the upward direction not to detect the remaining-toner in the toner chamber.

The first mechanism includes:

a crank shaft that includes a first crank pin that agitates the toner, the crank shaft being rotatably supported in the toner chamber;

wherein the remaining toner detecting mechanism comprises:

a second crank pin formed in the crank shaft; and a coupling member having a first end rotatably coupled to the second crank pin and a second end slidably inserted in a guide path provided above the toner chamber, the second end having a remaining-toner detecting element provided thereto.

The remaining-toner detecting element may be a magnetic flux-sensitive element.

The remaining-toner detecting element may be a permanent magnet.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

First Embodiment

{Overall Construction}

Figure 1:
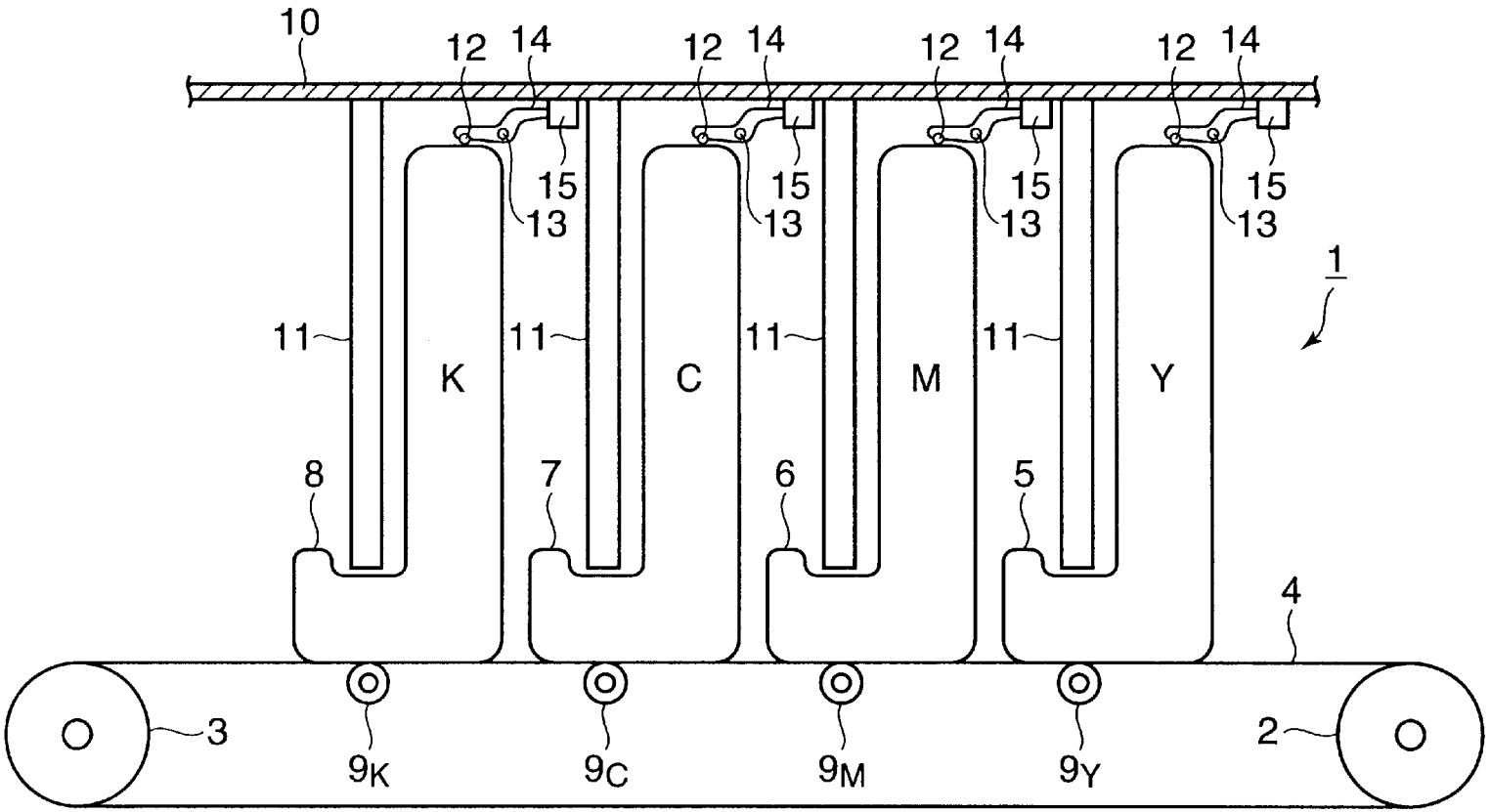
FIG. 1 is a side view illustrating an electrophotographic recording apparatus according to a first embodiment.

FIG. 1 is a side view illustrating an electrophotographic recording apparatus according to a first embodiment.

The electrophotographic color recording apparatus 1 includes a medium-transporting belt 4 that is entrained about drive rollers 2 and 3 and runs in the direction of travel of a print medium. A plurality of image forming apparatuses 5, 6, 7, and 8 of the same configuration and corresponding transfer rollers $\mathbf{9}_Y$, $\mathbf{9}_M$, $\mathbf{9}_C$, and $\mathbf{9}_K$ are aligned in the direction in which the medium transporting belt 4 runs. The image-forming apparatuses 5, 6, 7 and 8 form yellow, magenta, cyan, and black images, respectively.

Each of the image-forming apparatuses has an exposing unit 11, a sensor lever 14, and a sensor 15, which are provided on a lid 10 of the electrophotographic color recording apparatus 1. The sensor lever 14 is pivotally supported on a pin 13. The sensor lever 14 has one end to which a permanent magnet 12 is attached and the other end that engages and disengages from the sensor 15 to actuate and de-actuate the sensor 15. The pin 13 is press-fitted into a bracket, not shown, on the lid 10.

Figure 2:
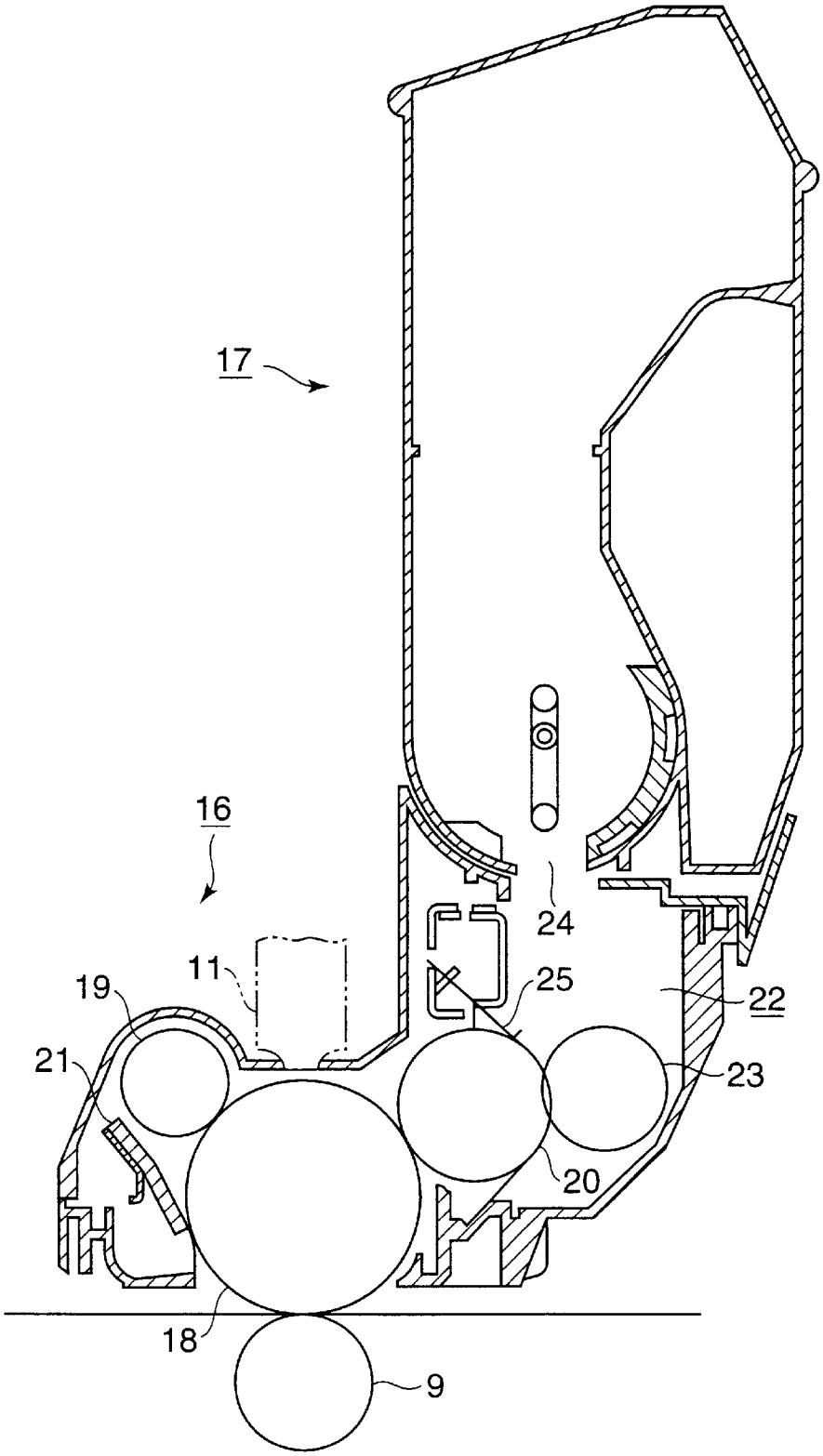
FIG. 2 is a cross-sectional view of an image-forming apparatus $\mathbf{5}_K$ for black image.

FIG. 2 is a cross-sectional view of the image-forming apparatus 8 for black image, by way of example. The image-forming apparatus 8 includes a print process cartridge 16, and a toner cartridge 17 that is removably attached to the print process cartridge 16. The image-forming apparatus 5, 6, and 7 are of the same construction as the image-forming apparatus 8.

The print process cartridge 16 has a photoconductive drum 18 on which an electrostatic latent image is formed. The photoconductive drum 18 extends in a direction transverse to the direction of travel of the print medium. Disposed around the photoconductive drum 18 are a charging roller 19, the exposing unit 11, a developing roller 20, the transfer roller 9, and a cleaning blade 21. The charging roller 19 charges the surface of the photoconductive drum 18 to a uniform potential. The exposing unit 11 illuminates the charged surface of the photoconductive drum 18 to form an electrostatic latent image thereon. The developing roller 20 develops the electrostatic latent image into a toner image. The transfer roller 9 causes the print medium to be charged to an opposite polarity to the toner image on the photoconductive drum 18, thereby allowing the toner image to be transferred onto the print medium. The cleaning blade 21 scrapes the residual toner from the photoconductive drum 18.

The developing unit 22 includes the developing roller 20 with which a toner-supplying roller 23 is in pressure contact. The toner-supplying roller 23 supplies the toner, discharged from the toner cartridge 17 through the opening 24, to the developing roller 23.

A blade 25 is in pressure contact with the developing roller 20 so as to form a thin layer of toner on the developing roller 20.

Figure 3:
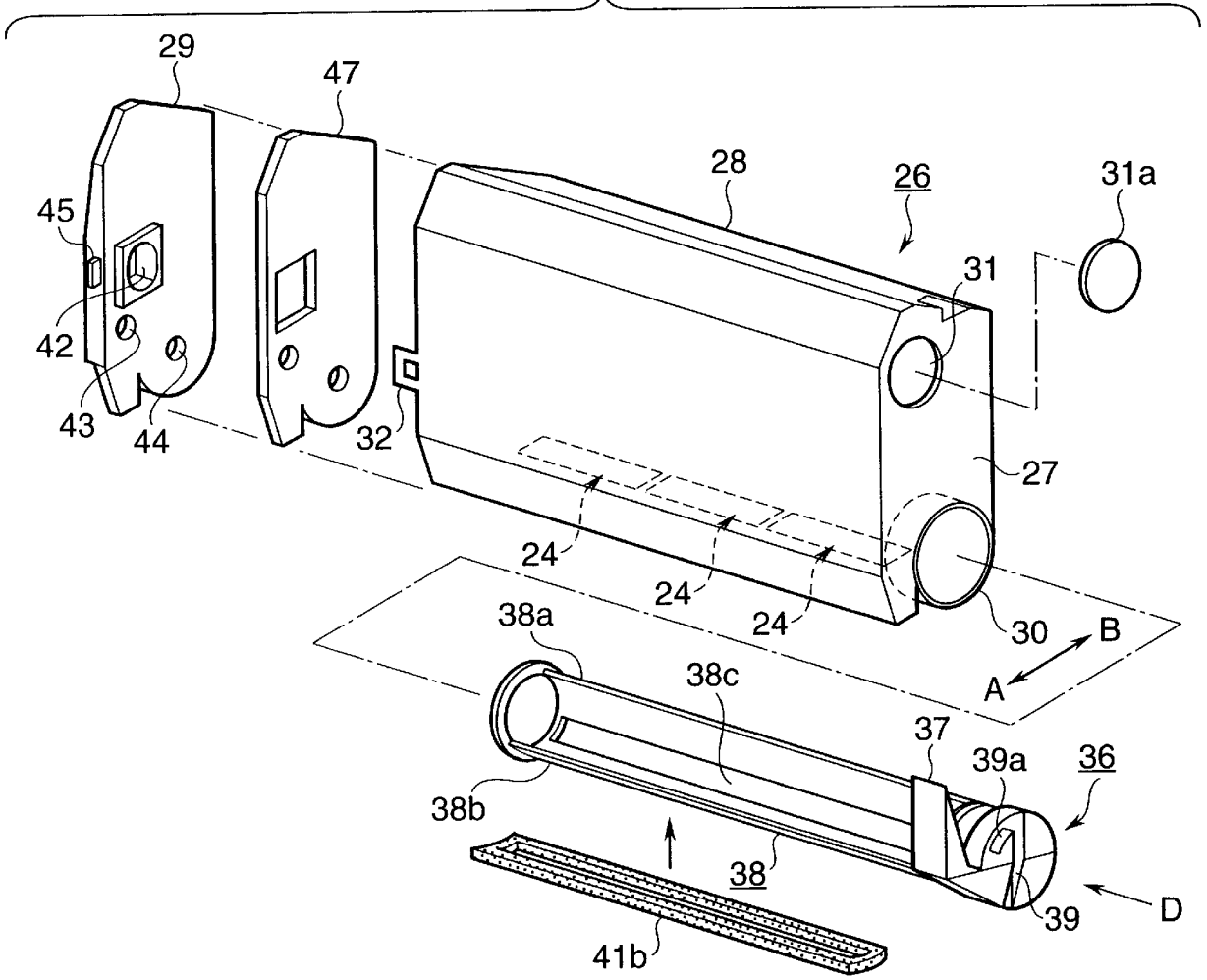
FIGS. 3 and 4 are exploded general perspective views of a toner cartridge according to the present invention.
Figure 4:
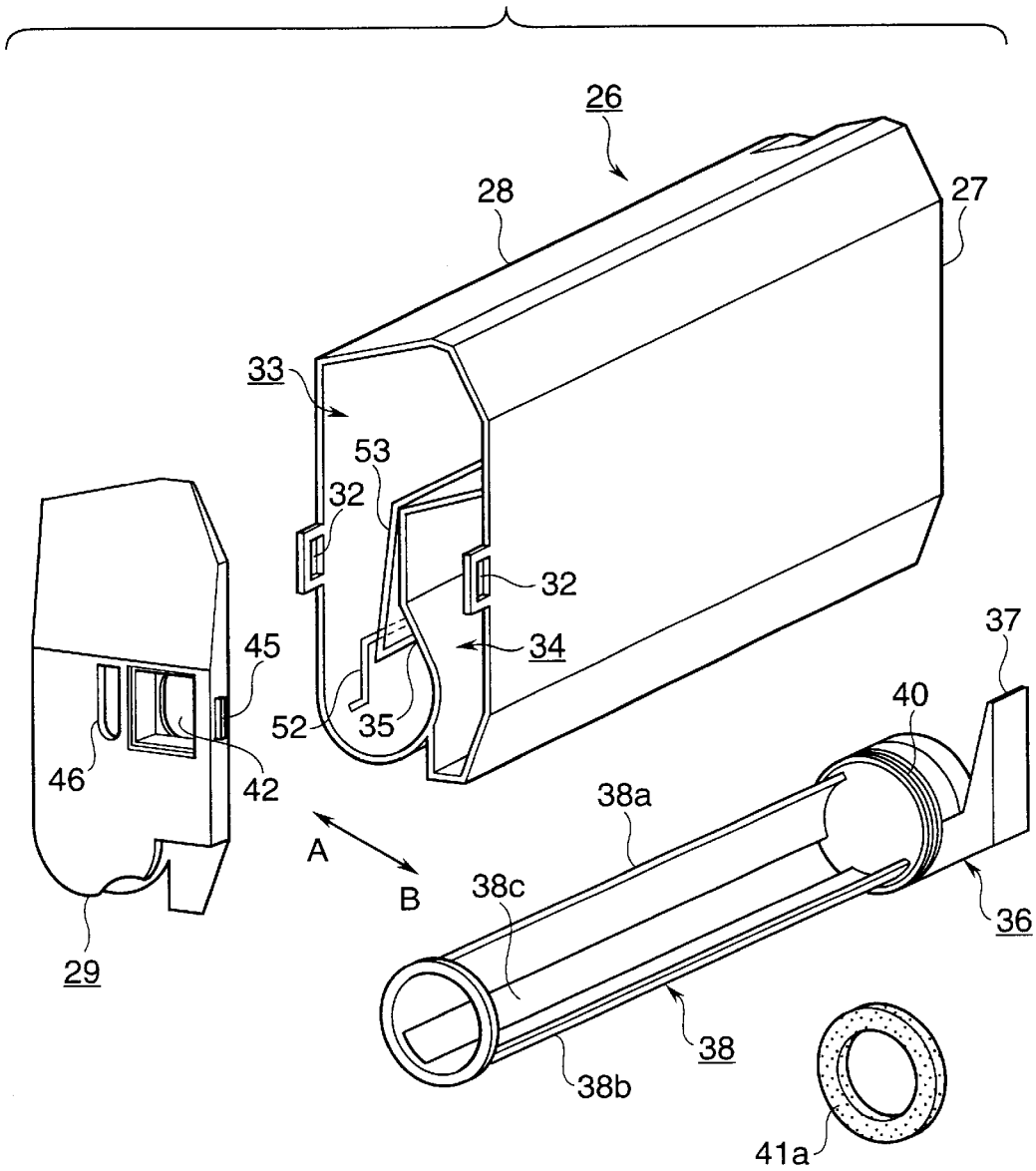

FIGS. 3 and 4 are exploded general perspective views of a toner cartridge according to the present invention.

Figure 5:
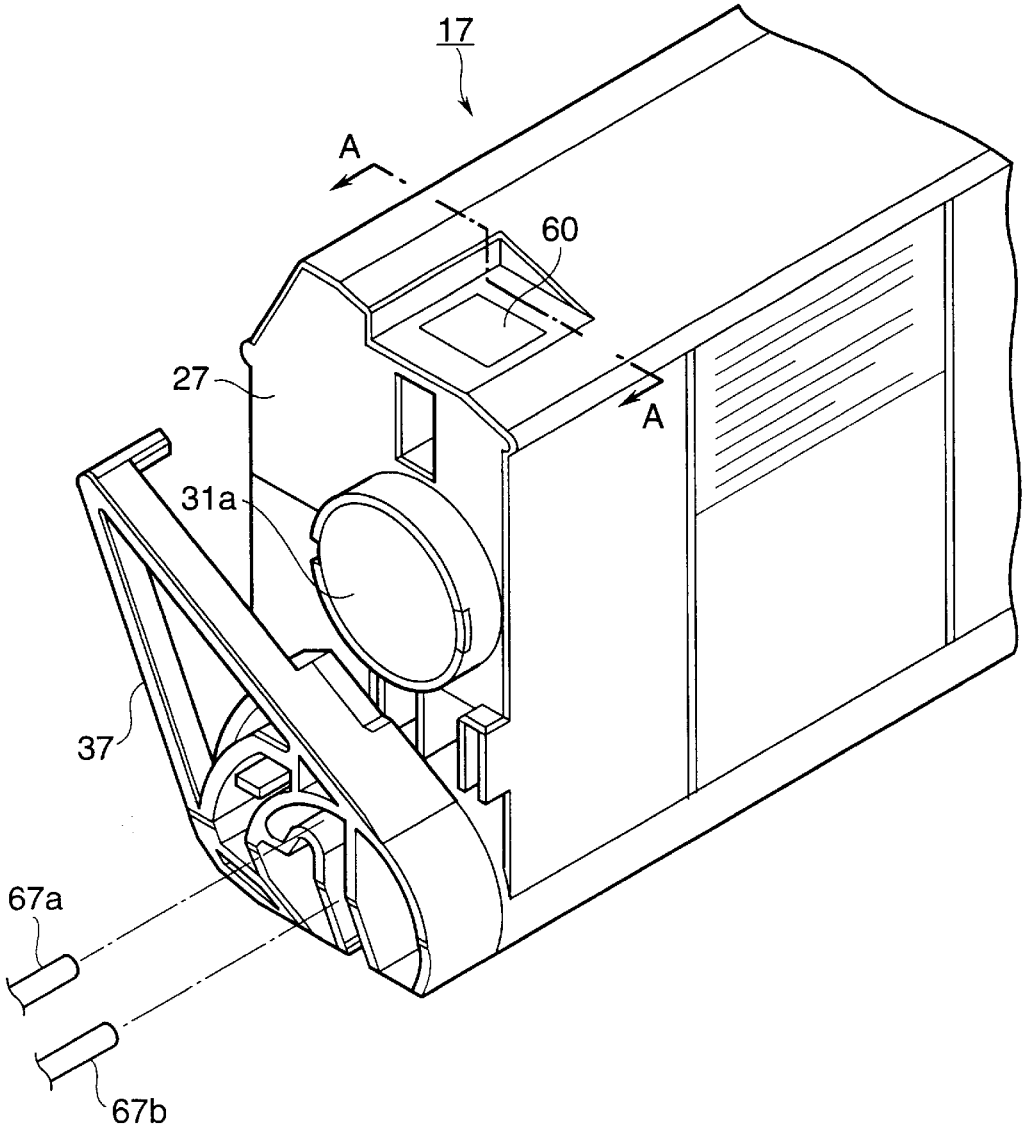
FIG. 5 is a fragmentary perspective view, showing a partial detail of the toner cartridge.

FIG. 5 is a fragmentary perspective view, showing a partial detail of the toner cartridge.

FIGS. 3 and 4 illustrate an outline of the construction of the toner cartridge 17 and the details are omitted. For example, the details of the operating knob 36 are not shown in FIGS. 3 and 4 but in FIG. 15. The details of the side plate are not shown in FIGS. 3 and 4 but in FIG. 14. As shown in FIG. 3, a cartridge case 26 of the toner cartridge 17 includes a housing 28 and a side plate 29. The housing 28 has a fresh toner chamber 33 and a waste toner chamber 34 defined side by side therein. The housing 28 is in one-piece construction with a side wall 27. The side plate 29 is fitted to the housing 28 to oppose the side wall 27.

The side wall 27 has a hollow cylindrical boss 30 into which an operating knob 36 of the toner cartridge 17 is inserted, and a toner filling opening 31 through which the fresh toner is charged into the fresh toner chamber 33 of the toner cartridge 17. The toner filling opening 31 is closed with a cap 31*a*. The housing 28 has engagement openings 32 formed on the periphery thereof by which the side plate 29 is assembled to the housing 28.

The fresh toner chamber 33 is formed with a plurality of openings 24 therein that are aligned in a longitudinal direction of the fresh toner chamber 33.

The operating knob 36 is in one piece with a knob lever 37 and a shutter 38 of an arcuate shape. The shutter 38 closes the openings 24 when the operating knob 36 is rotated to a closing position and opens the opening 24 when the operating knob 36 is rotated to an opening position. Before the toner cartridge 17 is attached to the print process cartridge 16, the operating knob 36 is at the closing position.

The knob 36 is formed with guide grooves 39 and 39*a* in its outer surface. The guide groove 39 receives later described projections 67*a* and 67*b* of the print process cartridge 16 when the toner cartridge 17 is attached into the print process cartridge 16.

The knob 36 is also formed with a circumferential groove 40 (FIG. 4) in its circumferential surface. The groove 40 receives an annular sealing sponge 41*a* that prevents the fresh, unused toner from leaking through the gap between the operating knob 36 and the boss 30. Another sealing sponge 41*b* is attached to the outer circumferential surface of the shutter 38 surrounding the openings 24, thereby preventing the fresh, unused toner from leaking through the shutter 38 and the body case 28.

The side plate 29 has an outer geometry fairly close to the cross section of the housing 28, and has projections 45 on its sides. When the side plate 29 is assembled to the housing 28, the projections 45 fit to the openings 32 of the housing 28. The side plate 29 is assembled to the housing 28 with a sealing sponge 47 sandwiched between the side plate 29 and the housing 28. The shape of the sealing sponge 47 is substantially the same as the outer geometry of the side plate 29.

The side plate 29 has an opening 42 formed therein through which waste toner scraped from the photoconductive drum 18 is directed into the waste toner chamber 34. The side plate 29 also has two holes 43 and 44 (FIG. 3) formed therein that receive bosses 49 and 54 (FIG. 14), which will be described later. The holes 44 and 43 face the fresh toner chamber 33 and the waste toner chamber 34, respectively.

The side plate 29 has a recess 46 formed therein that receives a projection 66 (FIG. 8) of the print process cartridge 16, which will be described later, to prevent the toner cartridge 17 from rotating relative to or disengaging from the print process cartridge 16.

{Waste Toner Chamber and Fresh Toner Chamber}

The housing 28 has an inner wall 35 that divides an inner space of the housing 28 into the fresh toner chamber 33 and the waste toner chamber 34. The inner wall 35 is positioned so that the fresh toner chamber 33 and the waste toner chamber 34 are aligned with each other in a direction transverse to the direction of travel of the print medium, i.e., in directions shown by arrows A and B of FIG. 4.

Figure 6:
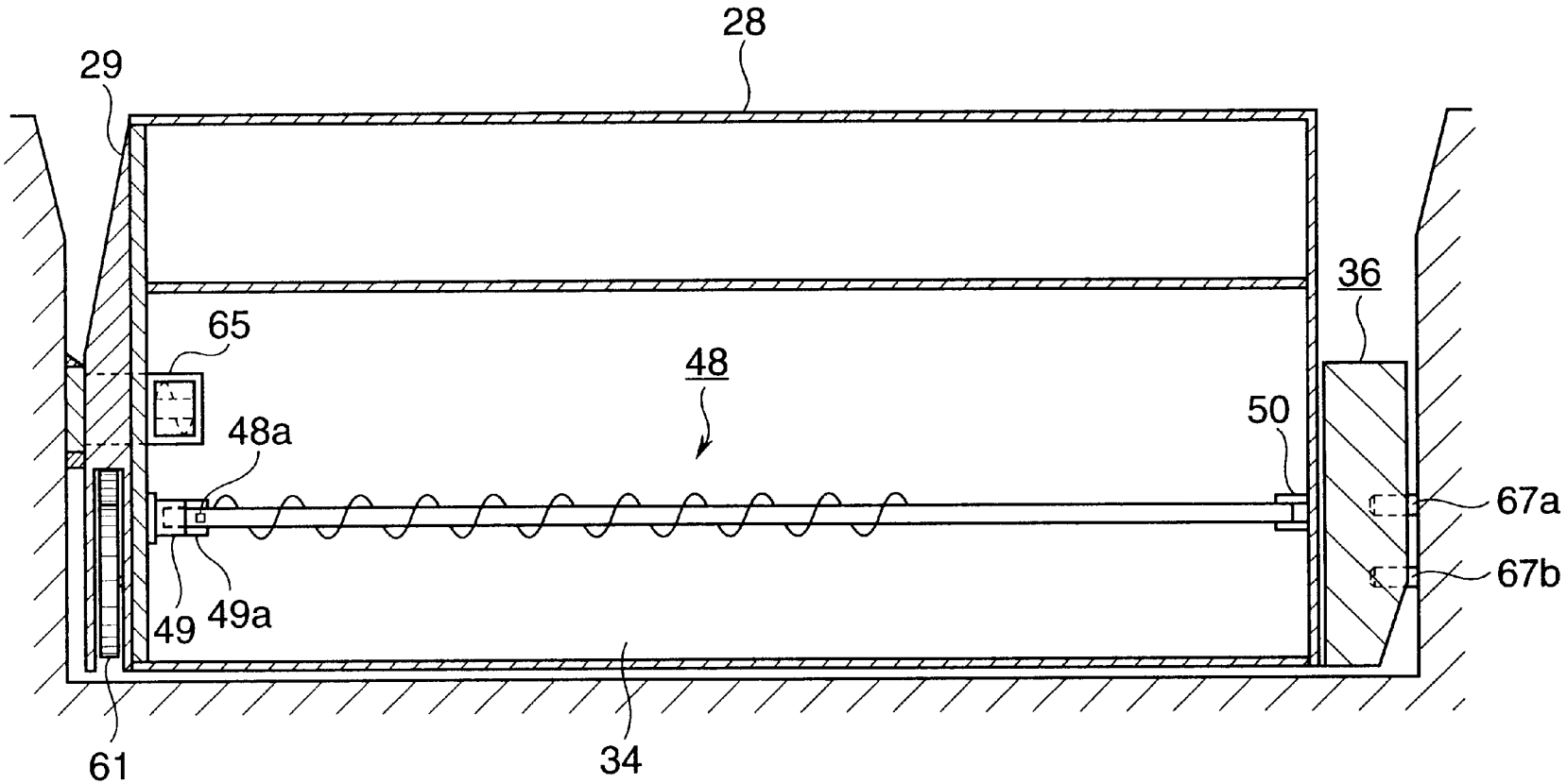
FIG. 6 is a cross-sectional view, illustrating the detail of a waste toner chamber.

FIG. 6 is a cross-sectional view, illustrating the detail of the waste toner chamber.

Referring to FIG. 6, a spiral shaft 48 extends horizontal in the waste toner chamber 34. The waste toner chamber 34 holds residual toner collected by the cleaning blade 21 from the photoconductive drum 18. The spiral shaft 48 is driven in rotation by a gear train 61. The tone exit 65 enters from the image forming apparatus to project into the waste toner chamber 34. The toner exit 65 directs waste toner into the waste toner chamber 34.

Figure 7:
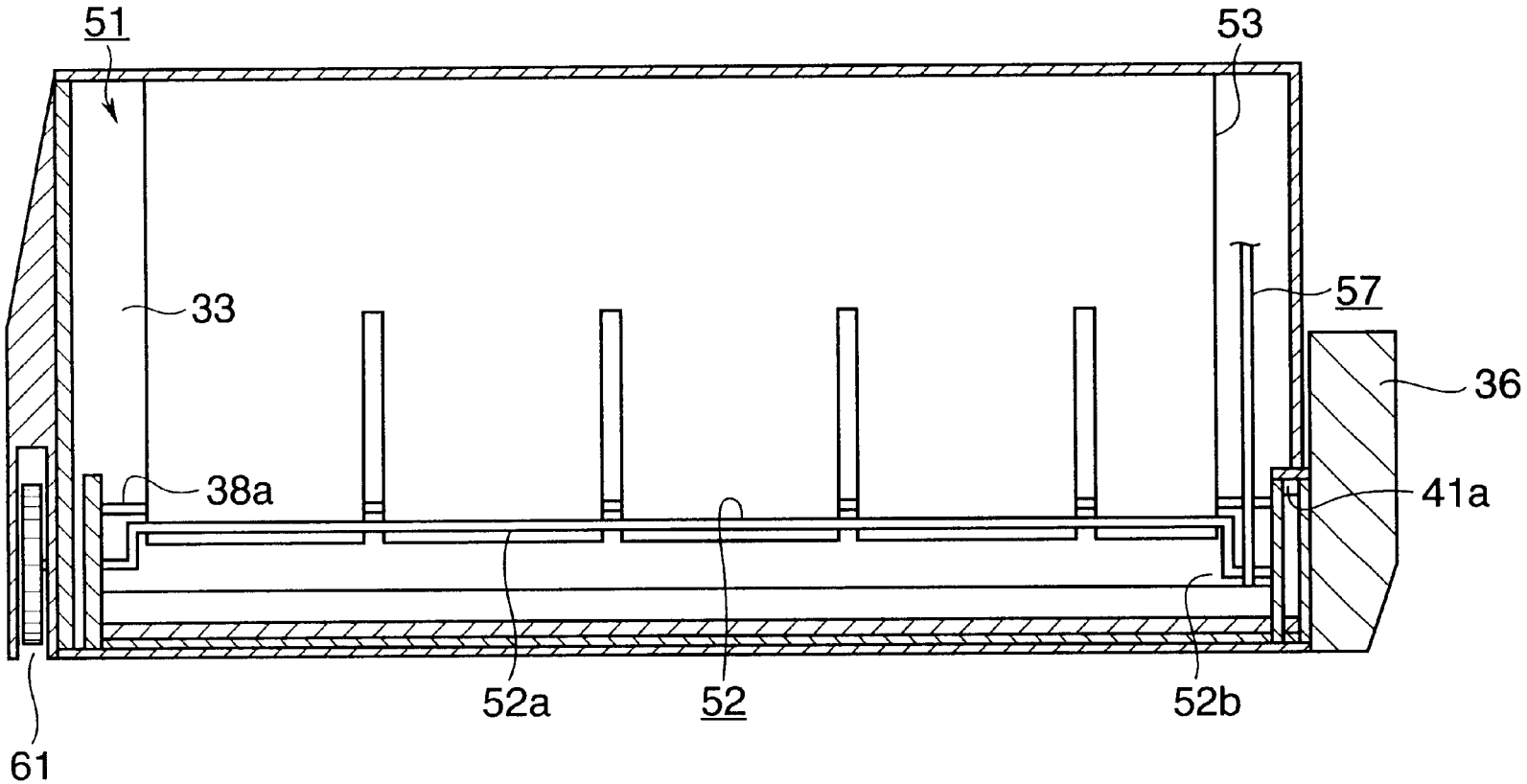
FIG. 7 is a cross-sectional view, illustrating the detail of a fresh toner chamber.

FIG. 7 is a cross-sectional view, illustrating the detail of the fresh toner chamber.

Referring to FIG. 7, the fresh toner chamber 33 holds fresh, unused toner therein and houses the crank shaft 52 and the swingable member 53 that form the toner the toner agitating mechanism 51. The swingable member 53 is suspended from an upper portion of the fresh toner chamber 33 so that the swingable member 53 can swing easily. The swingable member 53 has a few narrow cutouts formed therein, which facilitate smooth swinging motion of the swingable member 53. A rod 57 is rotatably coupled to the short crank pin 52*b* and reciprocates vertically when the crank shaft 52 is rotated by the gear train 61.

{Image Forming Apparatus}

Figure 8:
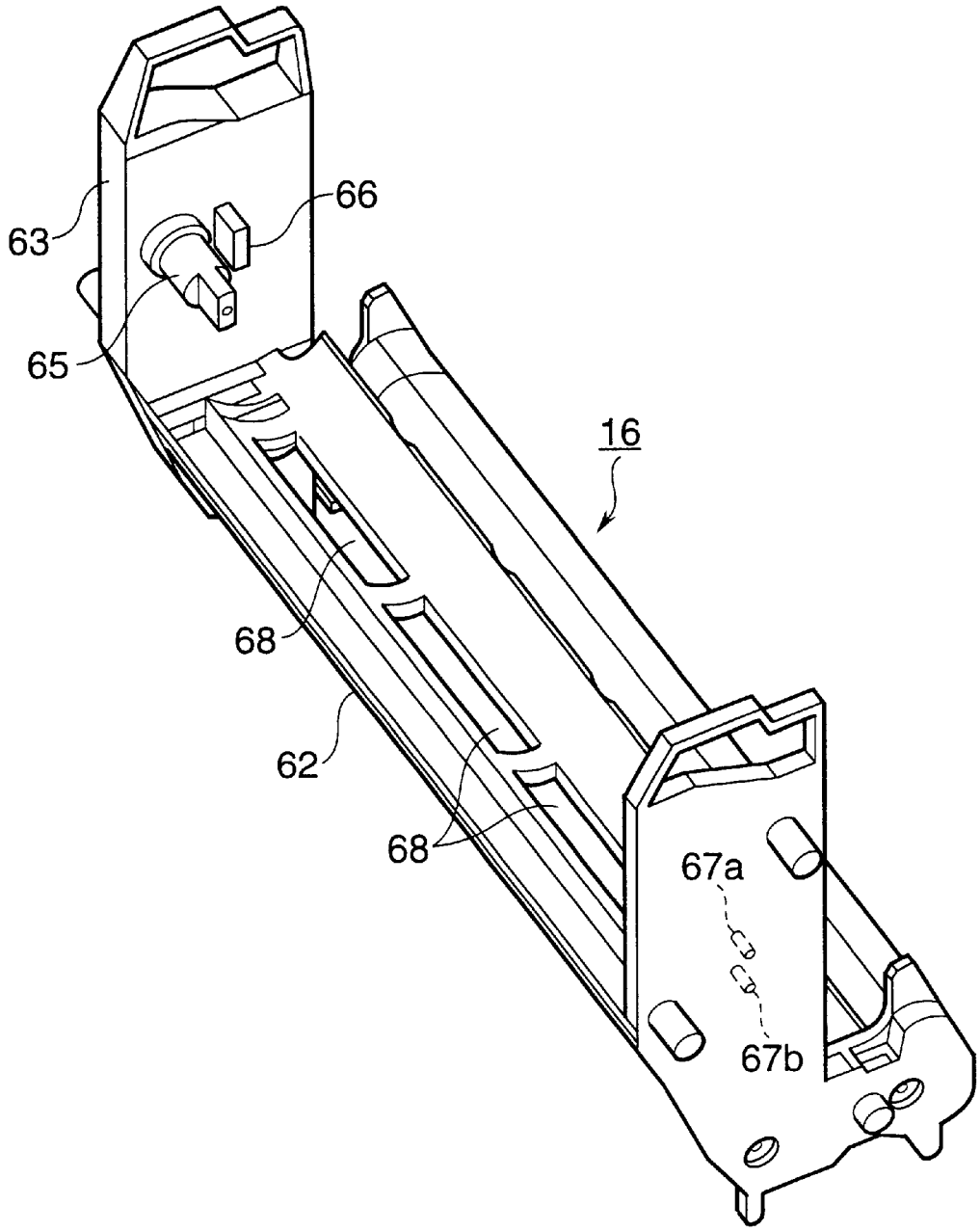
FIG. 8 is a perspective view, illustrating only an upper portion of a print process cartridge that receives the toner cartridge.

FIG. 8 is a perspective view, illustrating only an upper portion of the print process cartridge 16 that receives the toner cartridge 17.

The upper portion of the print process cartridge 16 is generally U-shaped and has opposing upright side walls 63 and 64, and a bottom 62 between the side walls 63 and 64. Below the bottom 62 are disposed a print engine that includes the photoconductive drum 18, charging roller 19, developing roller, cleaning blade 21, and toner supplying roller 23 as shown in FIG. 3.

The side wall 63 is formed with a waste toner exit 65 therein through which waste toner is directed into the waste toner chamber 34 of the toner cartridge 17. The side wall 63 also has the projection 66 formed near the toner exit 65. When the toner cartridge 17 is attached to the print process cartridge 16, the projection 66 fits into the recess 46 and the toner exist 65 fits into the opening 42.

The side wall 64 has projections 67*a* and 67*b* that fit guide groove 39*a* and 39 formed in the knob 36 of FIG. 3 when the toner cartridge 17 is attached to the print process cartridge 16.

Figure 9:
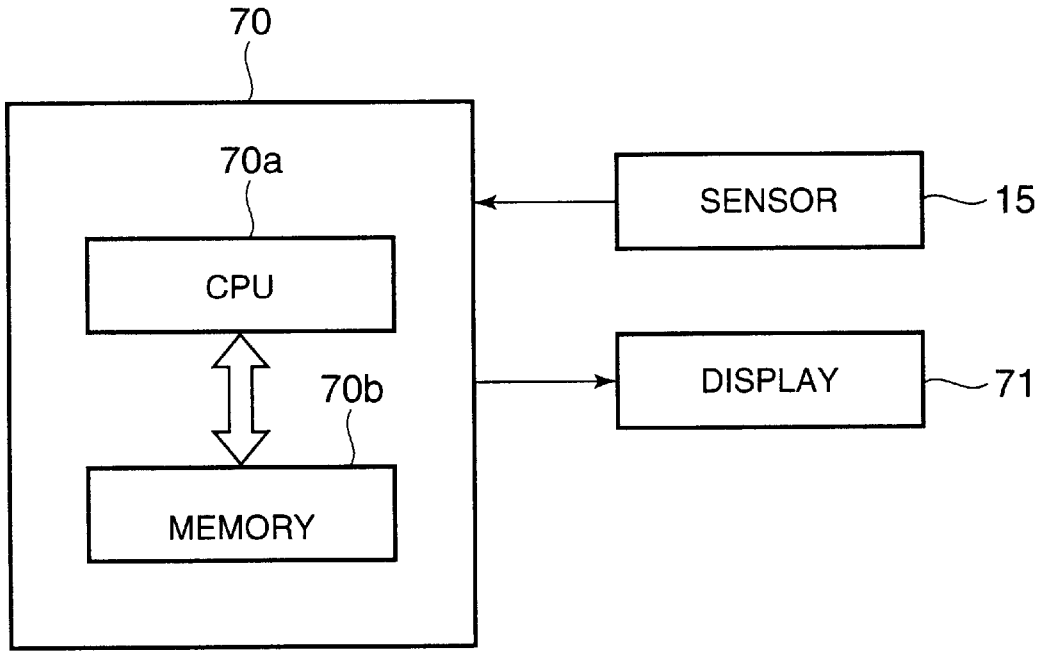
FIG. 9 is a control block diagram for detecting an amount of fresh toner remaining in the toner cartridge.

FIG. 9 is a control block diagram for detecting an amount of fresh toner remaining in the toner cartridge 17. The controller 70 is connected to the sensor 15 and a display 71. The controller 70 includes a CPU 70*a* and a memory 70*b*. The memory 70*b* stores a reference value and a message. The reference value indicates a value at which the toner in the fresh toner chamber is nearing exhaustion. The message is displayed on the display 71 indicating to the user that the toner cartridge 17 needs to be replaced.

{Attaching Toner Cartridge to Image Forming Apparatus}

A description will now be given of the operation of attaching the toner cartridge into the print process cartridge.

Figure 10:
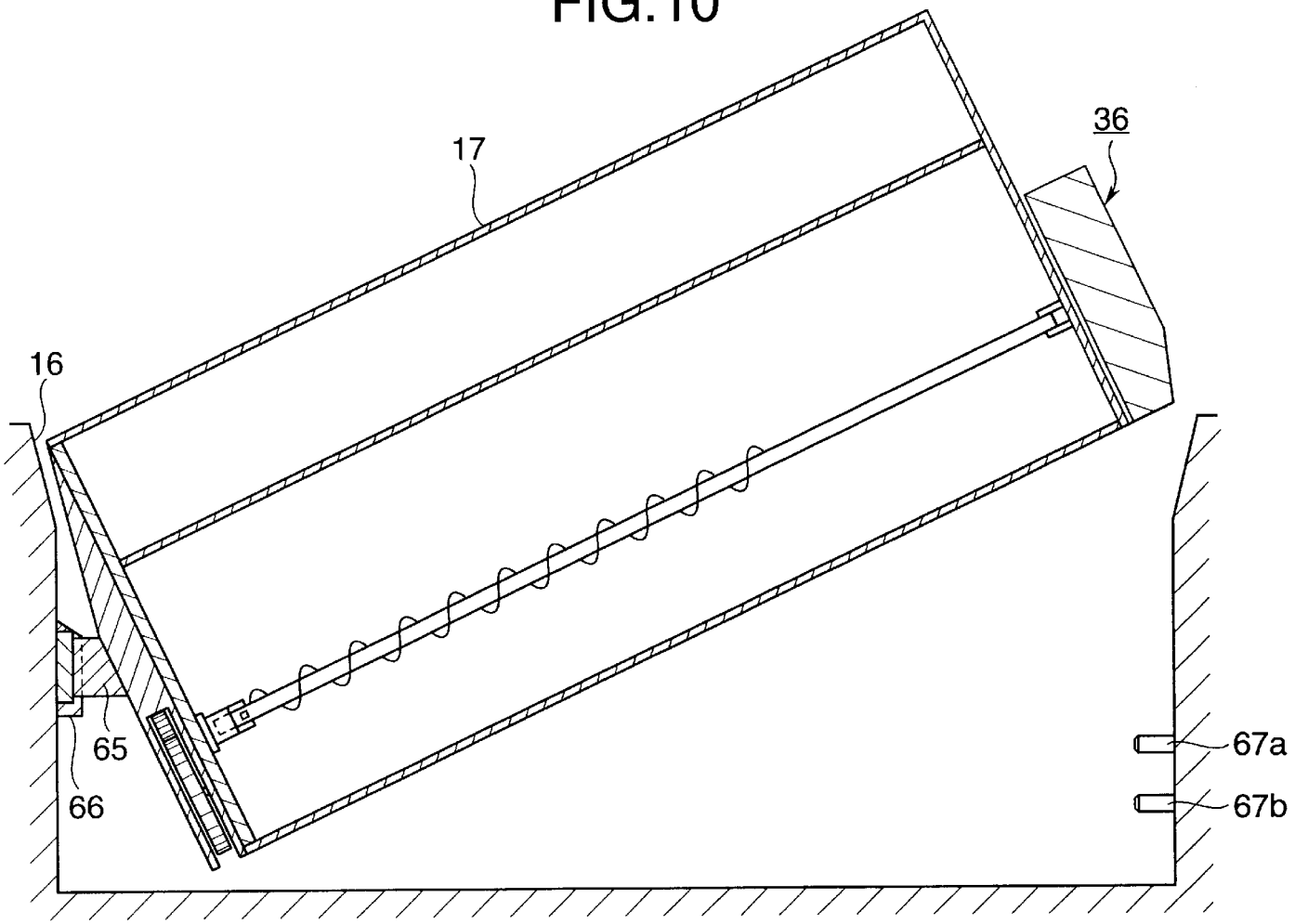
FIG. 10 illustrates the loading of the toner cartridge into the print process cartridge.

FIG. 10 illustrates the loading of the toner cartridge into the print process cartridge.

Figure 11A:
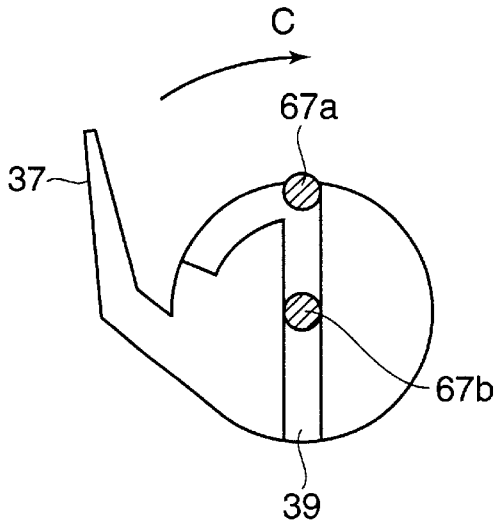
FIGS. 11A and 11B illustrate the operation of a knob lever, FIG. 11A showing the knob lever position before it is rotated and FIG. 11B showing the knob lever position after it has completely rotated in a direction shown by arrow C.
Figure 11B:
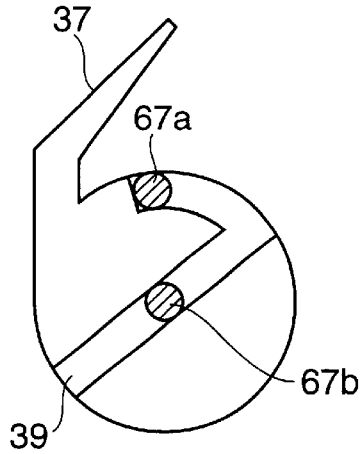

FIGS. 11A and 11B illustrate the operation of the knob lever, FIG. 11A showing the knob lever position before it is rotated and FIG. 11B showing the knob lever position after it has completely rotated in a direction shown by arrow C.

Figure 12:
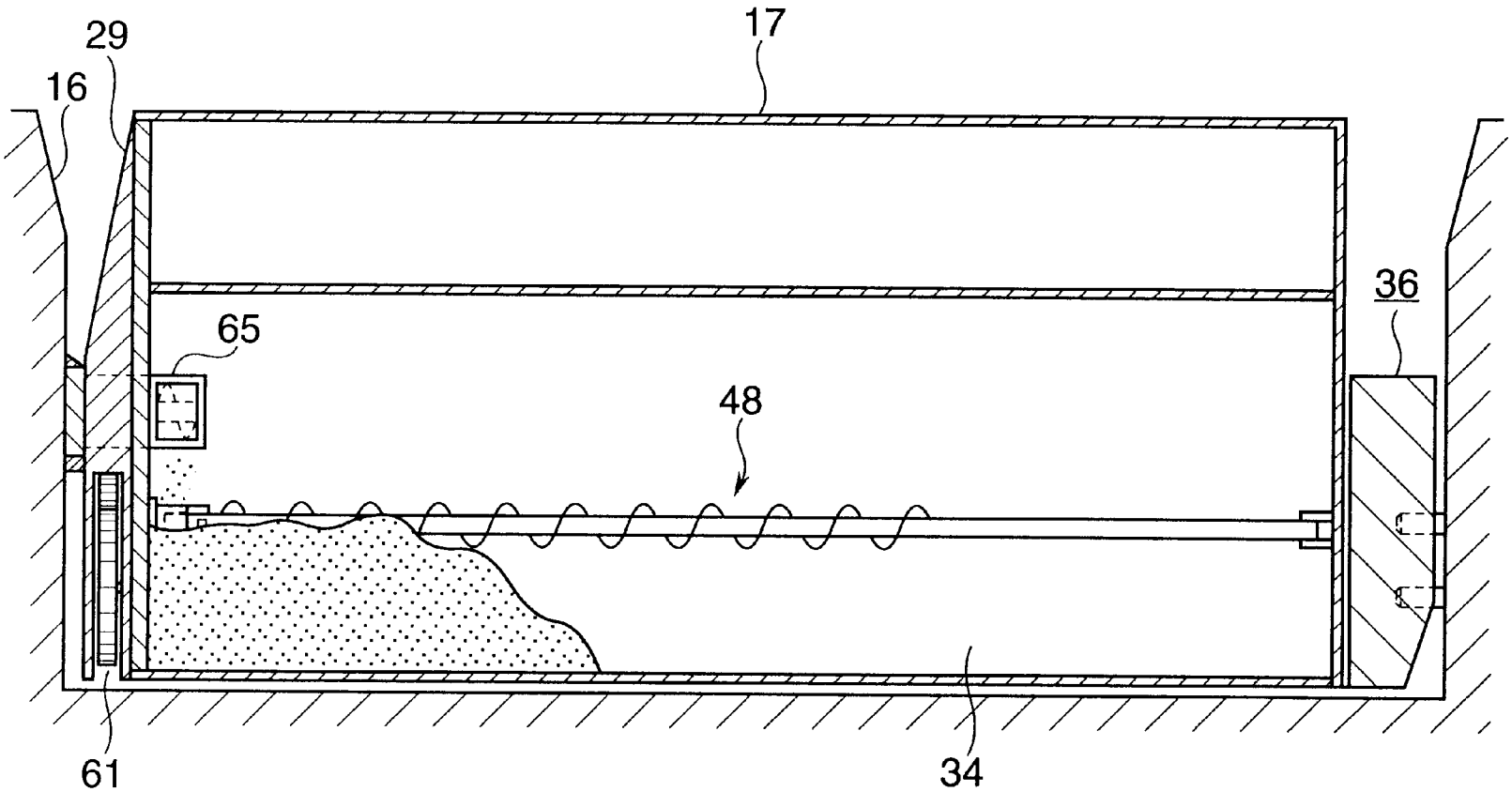
FIG. 12 is a cross-sectional side view, showing the waste toner chamber and illustrating the operation of the waste toner chamber.

FIG. 12 is a side view showing the waste toner chamber and illustrating the operation of the waste toner chamber.

As shown in FIG. 10, the toner cartridge 17 is first tilted so that the toner exit 65 fits to the opening 42 formed in the side frame 29 of the toner cartridge 17.

After the opening 42 abuts the toner exit 65, the operating knob 36 side is slowly lowered so that the toner cartridge 17 lies horizontal in the print process cartridge 16. At this moment, the projection 66 is received in the recess 46 formed in the side plate 29 of FIG. 4, thereby positioning the toner cartridge 17 relative to the print process cartridge 16 and preventing the toner cartridge 17 from rotating or disengaging from the print process cartridge 16.

As the operating knob 36 is further lowered, the projections 67*a* and 67*b* on the print process cartridge 16 enter the guide groove 39*a* and 39 formed in the operating knob 36. When the toner cartridge 17 becomes completely horizontal, the guide groove 39 receives the projections 67*a* and 67*b* therein completely, thereby firmly holding the operating knob 36 relative to the print process cartridge 16 and preventing the toner cartridge 17 from rotating or disengaging form the print process cartridge 16.

After the toner cartridge 17 has become horizontal, when the knob lever 37 is rotated in the direction shown by arrow A as shown in FIG. 11A, the shutter 38 in one piece with the knob lever 37 also rotates. When the projection 67*a* abuts a part of the knob lever 37 as shown in FIG. 11B, the fresh, unused toner is discharged from the fresh toner chamber 33 into the print process cartridge 16.

Referring to FIG. 12, the waste toner is directed into the waste toner chamber 34 through the toner exit 65. The gear train drives the spiral shaft 48 to rotate so that the rotating spiral shaft 48 makes the pile of toner grow from the near end (i.e., toner exit 65) of the waste toner chamber toward the far end (i.e., opening 42) of the chamber.

{Toner Agitating Mechanism}

Figure 13:
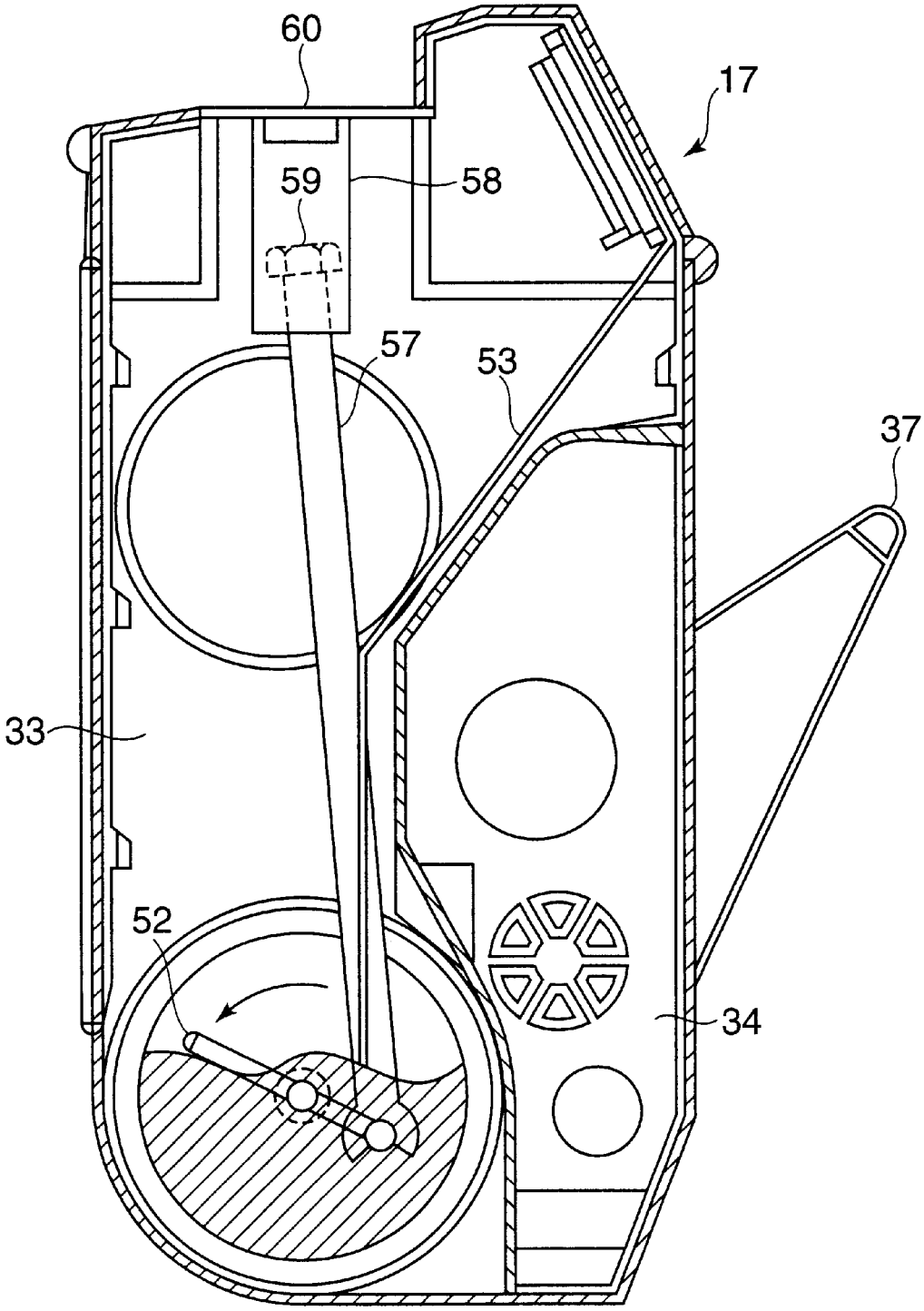
FIG. 13 is a cross-sectional view taken along line A—A of FIG. 5.

FIG. 13 is a cross-section taken along line A—A of FIG. 5.

Referring to FIG. 13, the rod 57 has a lower end coupled to the short crank pin 52*b* and an upper end to which a magnetic material 59 is attached. The upper end portion is slidably inserted into a guide 58 provided on an upper wall of the body case 28. The guide 58 has an upper wall to which a film 60 is attached. There is the swingable member 53 suspended from the upper portion of the fresh toner chamber 33.

FIG. 7 is a cross-sectional view illustrating the detail of the fresh toner chamber.

A toner agitating mechanism 51 is provided in the fresh toner chamber 33. The toner agitating mechanism 51 is immediately over the openings 24 and is rotated to agitate the toner in the fresh toner chamber 33.

The toner agitating mechanism 51 includes a crank shaft 52 and a resilient swingable member 53. The crank shaft 52 extends horizontal.

The crank shaft 52 includes a long crank pin 52*a* and a short crank pin 52*b*. The long crank pin 52*a* extends substantially across the entire fresh toner chamber 33. As the crank shaft 52 rotates, the long crank pin 52*a* engages the lower end portion of the resilient swingable member 53 to cause the member 53 to flex, and then disengages from the member 53 to allow the member 53 to resiliently swing back.

The crank shaft 52 has one end rotatably received in a recess formed in a boss 54, which in turn is rotatably received in a supporting hole 44 (FIG. 3). The boss 54 has a projection 54*a* that engages the long crank pin 52*a* when the boss 54 rotates. The crank shaft 52 has the other end supported by the inner side of the operating knob 36.

Figure 14:
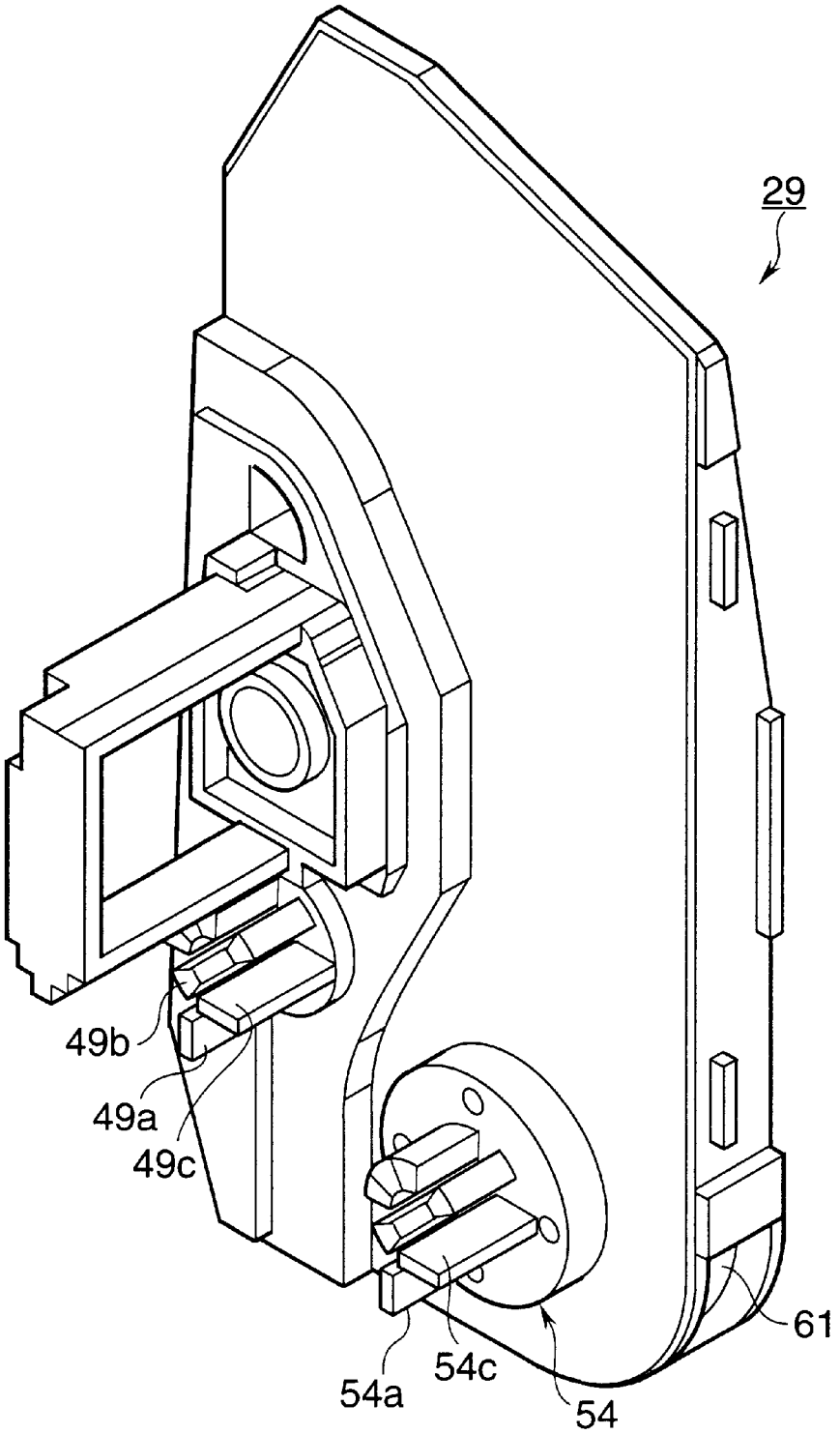
FIG. 14 is a perspective view, illustrating the detail of a side plate.

FIG. 14 is a perspective view illustrating the detail of a side plate.

The bosses 49 and 54 are in mesh with the gear train 61 through, for example, resilient tongues. When the gear train 61 rotates, the bosses 49 and 54 are driven in rotation. The gear train 61 is coupled to a drive gear, not shown, of the print process cartridge 16. The drive gear drives the gear train 61 in rotation.

The bosses 49 and 54 have projections 49*a* and 54*a*. When the projections 49*a* and 54*a* rotate, they abut the projection 48*a* of the spiral shaft 48 and the short crank pin 52*b* of the crank shaft 52, respectively, to drive the spiral shaft 48 and crank shaft 52 in rotation.

Figure 15:
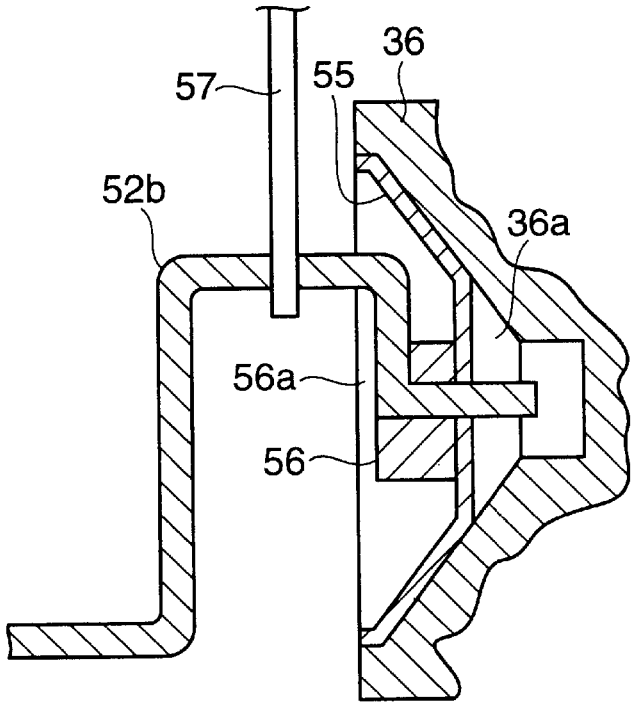
FIG. 15 is a fragmentary cross-sectional view, illustrating the relationship between an operating knob and a toner agitating mechanism.

FIG. 15 is a fragmentary view illustrating the relationship between an operating knob and the toner agitating mechanism.

Figure 16:
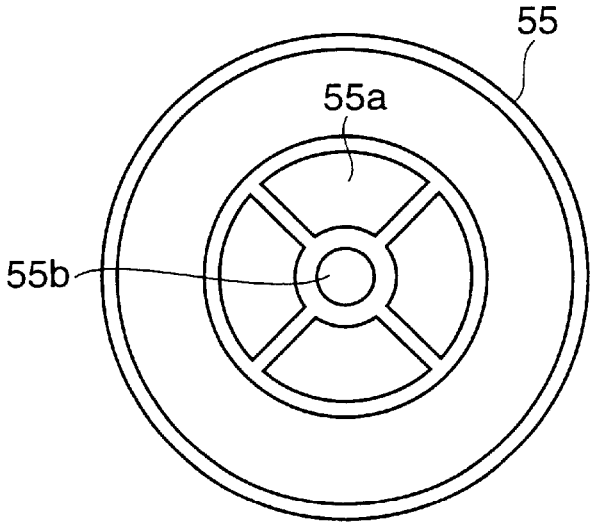
FIG. 16 is an elevation view of the operating knob.

FIG. 16 is an elevation view of the operating knob. The operating knob 36 is formed with a generally cone-shaped recess 36*a*. The recess 36*a* receives a retainer 55 in the shape of a truncated cone. One end of the crank shaft 52 extends through a piece 56 and is rotatably received in the retainer 55. The short crank pin 52*b* fits into a recess 56*a* formed in the piece 56 such that the short crank pin 52*b* is clear of the retainer 55.

The retainer 55 has a plurality of windows 55*a* formed therein such that toner entered the truncated cone shaped recess 36*a* in the operating knob 36 can be returned through holes 55*a* into the fresh toner chamber 33.

Figure 17A:
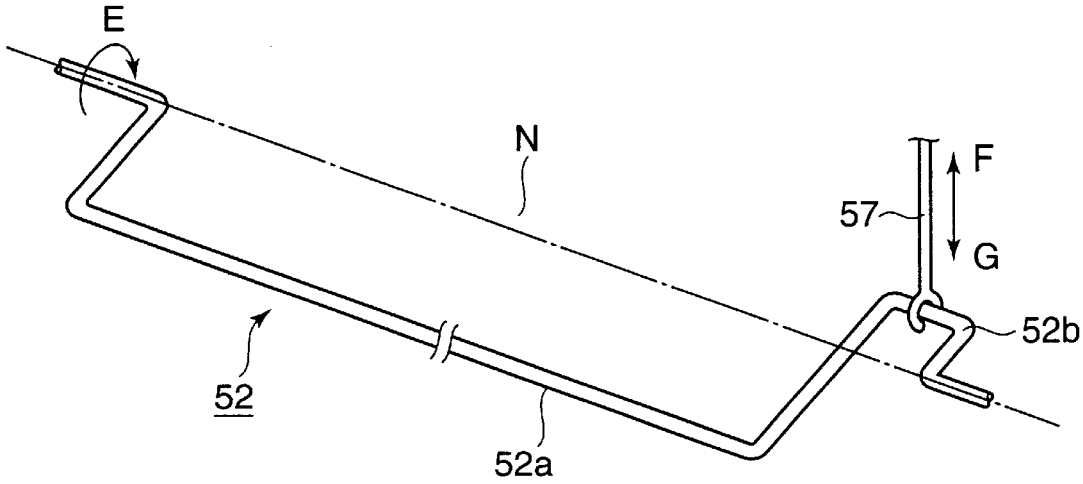
FIG. 17A is a perspective view, illustrating the overall structure of a crank shaft.

FIG. 17A is a perspective view illustrating the overall structure of the crank shaft.

Figure 17B:
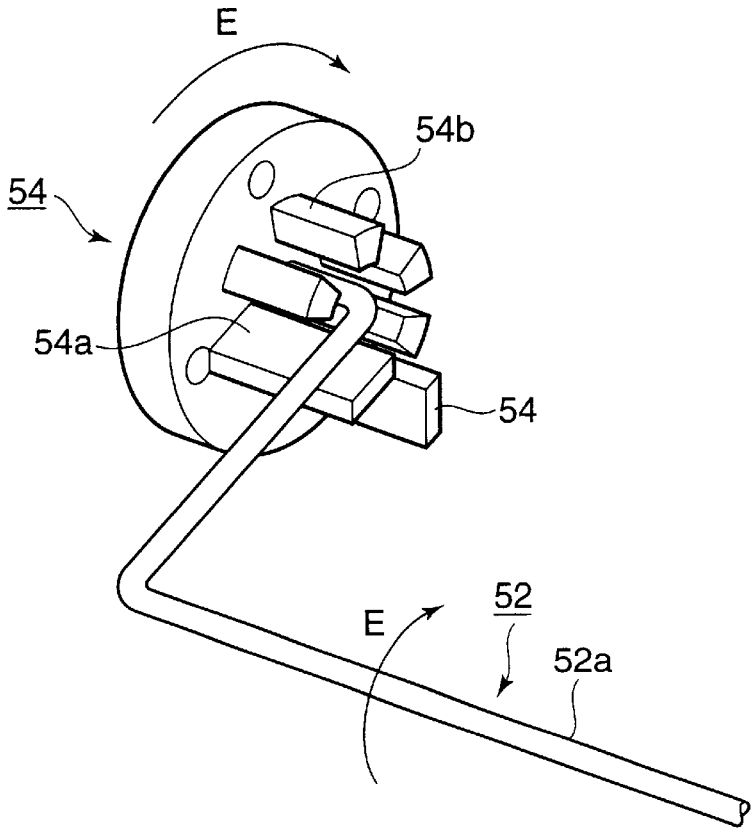
FIG. 17B is a fragmentary perspective view of a boss that drives the crank shaft.

FIG. 17B is a fragmentary perspective view of the boss that drives the crank shaft.

Referring to FIG. 17A, the crank shaft 52 rotates about a center line N when the boss 54 rotates. The crank 52 is heavier on the side of the long crank pin 52*a* than on the side of a short crank pin 52*b*. Therefore, the crank 52 will tend to be at rest with the long crank pin 52*a* at the bottom and the short crank pin 52*b* at the top if the crank 52 is not left free to rotate. The short crank pin 52*b* is coupled to a rod 57, which is rotatable about the short crank pin 52*b*. When the crank 52 rotates about the center line N, the rod 57 reciprocates vertically in directions shown by arrows F and G.

Referring to FIG. 17B, the crank 52 is rotatably held in the boss 54 by circumferentially aligned pieces 54*b*. When the boss rotates in a direction shown by arrow E, the piece 54*a* abuts the long crank pin 52*a* of the crank 52, causing the crank 52 to rotate in the E direction together with the boss 54. When the long crank pin 52*a* is rotated past its highest position, the crank 52 quickly rotates by 180 degrees so that the long crank pin 52*a* drops to its lowest position if little or no fresh toner is left in the fresh toner chamber 33. A piece 54*c* serves as a stopper against which the long crank pin 52*a* abuts.

{Operation of Waste Toner Collecting Mechanism}

Referring again to FIG. 12, when printing is performed, both the spiral shaft 48 and the crank shaft 52 are rotating. The residual toner, which was not transferred to the print medium but left on the photoconductive drum 18, is scraped by the cleaning blade 21 shown in FIG. 2, and is then collected through the toner exit 65 into the waste toner chamber 34.

The waste toner falls in the waste toner chamber 34 and piles up to the height of the spiral shaft 48. Then, the rotating spiral shaft 48 makes the pile of toner grow from the near end (i.e., toner exit 65) of the waste toner chamber toward the far end (i.e., opening 42) of the chamber.

Meanwhile, the crank shaft 52 is rotating in the fresh toner chamber 33 and the CPU 70*a* of the controller 70 detects the remaining toner in the toner cartridge 17 by means of the sensor 15.

{Operation of Fresh Toner Agitating Mechanism}

The description will be given of the operation of detecting an amount of toner that remains in the toner cartridge.

FIGS. 18A–18G illustrate the operation of the agitating mechanism.

Figure 18A:
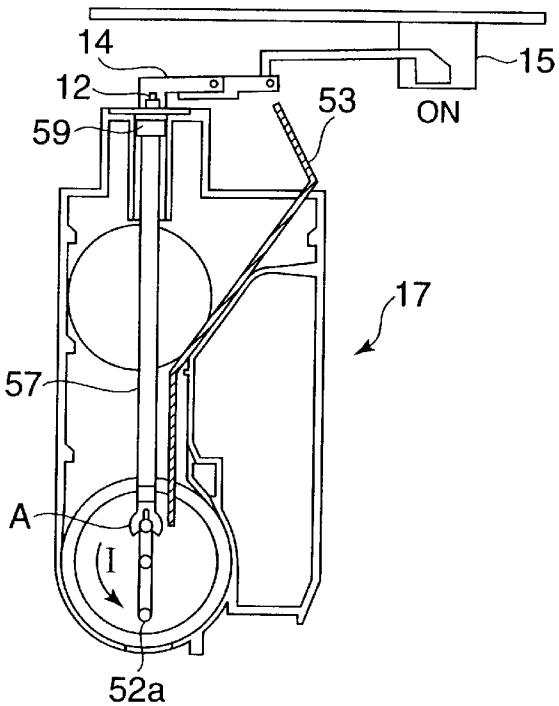
FIGS. 18A–18G illustrate the operation of the agitating mechanism.
Figure 18B:
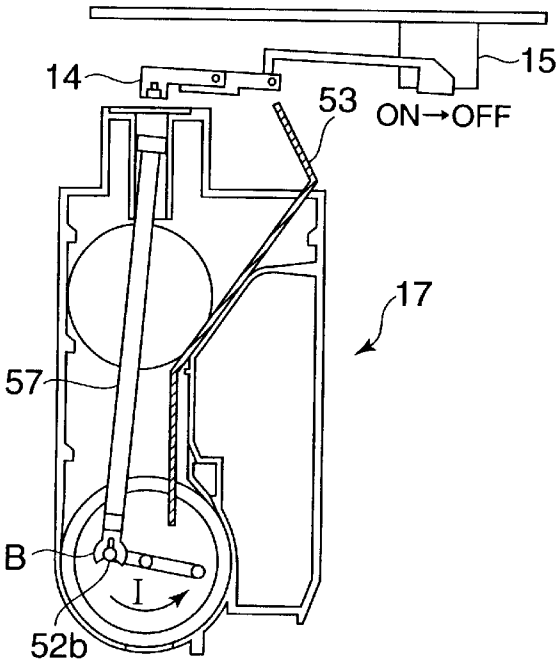
Figure 18C:
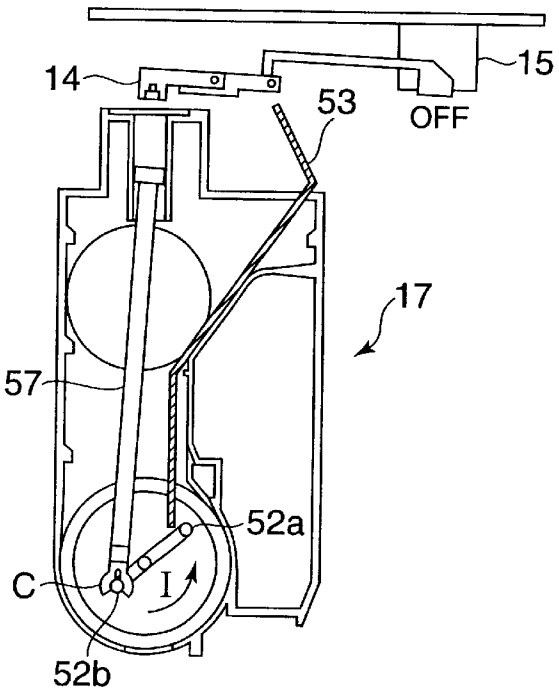
Figure 18D:
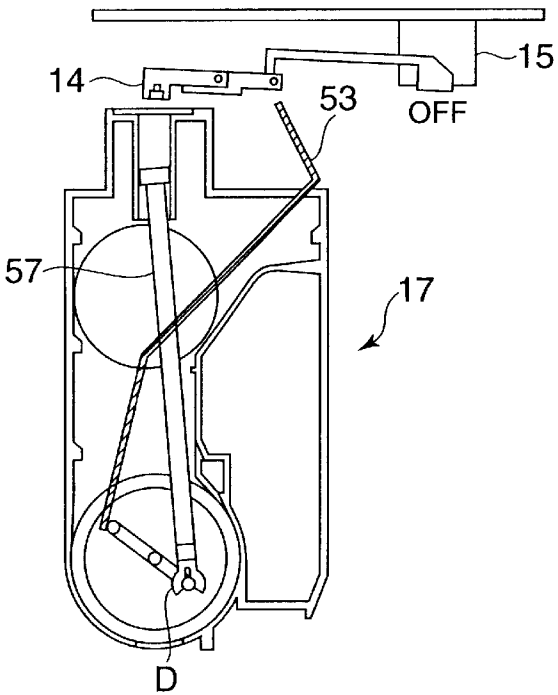
Figure 18E:
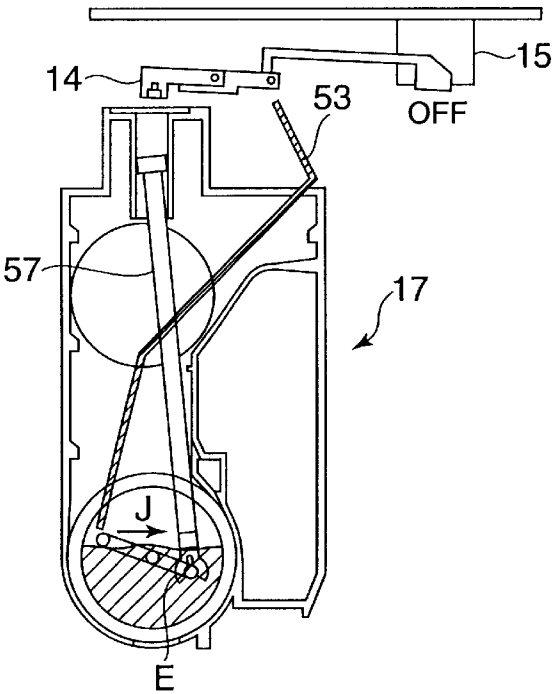
Figure 18F:
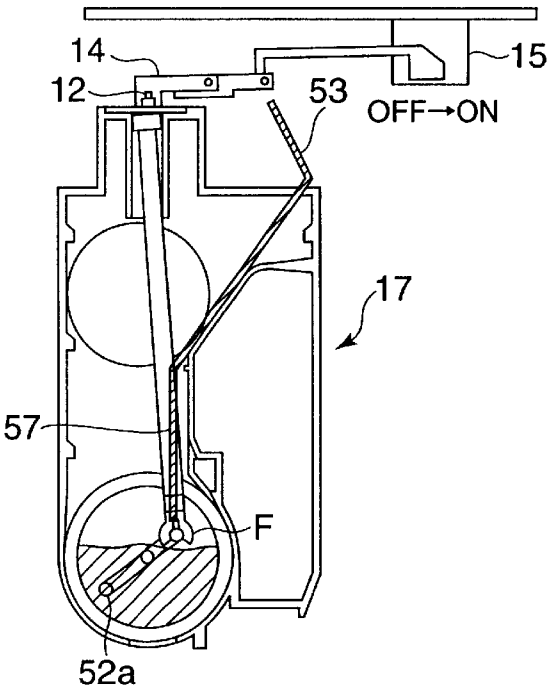
Figure 18G:
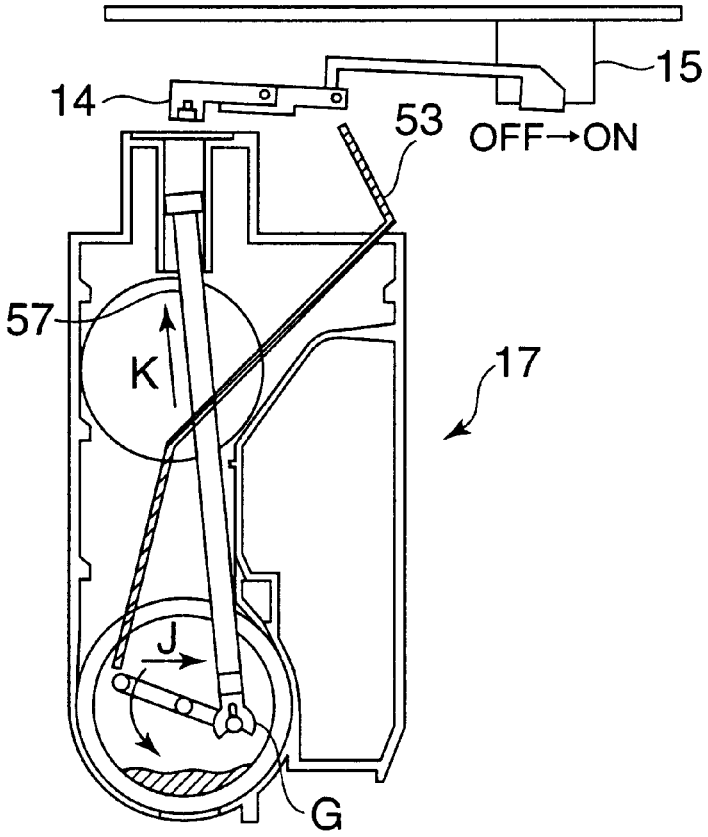
Figure 18H:
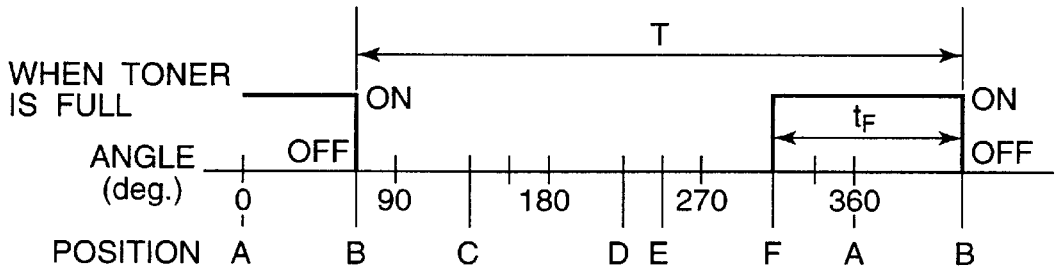
FIG. 18H illustrates the relationship between the ON time of a sensor and the position of a short crank pin when the remaining toner in The toner cartridge is still sufficient.

FIG. 18H illustrates the relationship between the ON time of the sensor 15 and the position of the short crank pin when the remaining toner in the toner cartridge is still sufficient.

Figure 18I:
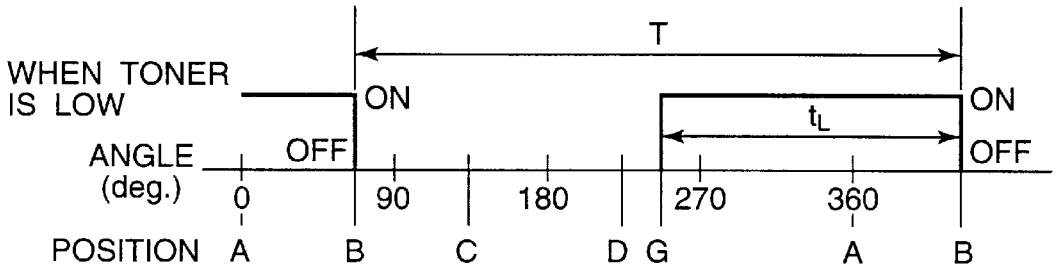
FIG. 18I illustrates the relationship between the ON time of the sensor and the position of the short crank pin when the remaining toner in the toner cartridge is still sufficient.

FIG. 18I illustrates the relationship between the ON time of the sensor 15 and the position of the short crank pin when the remaining toner in the toner cartridge is still sufficient.

The crank shaft 52 is heavier on the side of the long crank pin 52*a* than on the side of the short crank pin 52*b*, so that the long crank pin 52*a* tends to drop to the bottom of the fresh toner chamber 33 at all times.

Regardless of whether the remaining toner is still sufficient or nearing exhaustion, the agitating mechanism operates as follows:

When the long crank pin 52*a* is at its lowest position and the boss 54 is driven by the gear train 61 in rotation in the E direction of FIG. 17B, the projection 54*a* of the boss 54 moves into abutting engagement with the long crank pin 52*a*. Then, the projection 54*a* pushes the long crank pin 52*a* so that the long crank pin 52*a* rotates together with the projection 54*a*. When the long crank pin 52*a* is at position A (highest) as shown in FIG. 18A, the magnetic material 59 is being attracted to the permanent magnet 12 so that the sensor 15 remains ON. The boss 54 is further driven by the gear train 61 and therefore the short crank pin 52*b* further rotates together with the projection 54*a*.

When the long crank pin 52*a* reaches position B as shown in FIG. 18B, the magnetic material 59 is forcibly moved out of attraction engagement with the permanent magnet 12 so that the sensor 15 becomes OFF.

When the long crank pin 52*a* reaches position C as shown in FIG. 18C, the long crank pin 52*a* engages the swingable member 53 to cause the swingable member 53 to flex. As the long crank pin 52*a* is further rotated, the long crank pin 52*a* causes the swingable member 53 to further flex, while also sliding on the swingable member 53. The long crank pin 52*a* continues to slide on the swingable member 53 and reaches the free end of the swingable member 53 as shown in FIG. 18D where the swingable member 53 has swung with a maximum amplitude.

If the remaining toner in the fresh toner chamber 33 is still sufficient, the agitating mechanism operates subsequently as follows:

As shown in FIG. 18E, the long crank pin 52*a* moves out of abutting engagement with the swingable member 53 and the swingable member 53 resiliently swings in a direction shown by arrow J back to its original position. However, because the remaining toner in the fresh toner chamber 33 is still sufficient, the long crank pin 52*a* cannot fall to its lowest position but rests on the pile of toner as shown in FIG. 18E. Thus, the long crank pin 52*a* gradually enters the pile of toner as the long crank pin 52*a* is further rotated by the projection 54*a*.

When the long crank pin 52*a* reaches position F as shown in FIG. 18F, the magnetic material 59 is close to the permanent magnet 12 and is again attracted to the permanent magnet 12 secured to the sensor lever 14, so that the sensor 15 again becomes ON. Then, when the short crank pin 52*b* rotates past position A in FIG. 18A to position B shown in FIG. 18B, the magnetic material 59 again moves out of attraction engagement with the permanent magnet 12, causing the sensor 15 to become OFF. Thus, when the remaining toner is sufficient, the operation proceeds in the order of FIG. 18A, FIG. 18B, FIG. 18C, FIG. 18D, FIG. 18E, FIG. 18F, and FIG. 18A.

If the remaining toner is nearing exhaustion, the agitating mechanism operates as follows:

When the long crank pin 52*a* rotates past position D as shown in FIG. 18D, the long crank pin 52*a* moves out of engagement with the swingable member 53 as shown in FIG. 18G so that the swingable member 53 swings in the J direction back to its original position. Because the remaining toner in the fresh toner chamber 33 is nearing exhaustion, the long crank pin 52*a* is not blocked by the pile of toner but quickly drops to its lowest position as shown in FIG. 18A. Thus, when the remaining toner is nearing exhaustion, the operation proceeds in the order of FIG. 18A, FIG. 18B, FIG. 18C, FIG. 18D, FIG. 18G, and FIG. 18A.

Thus, as is clear from FIGS. 18H and 18I, the ON time of the sensor 15 is longer when the remaining toner in the fresh toner chamber 33 is still sufficient than when the remaining toner in the fresh toner chamber 33 is nearing exhaustion, i.e., $t_L > t_F$.

The CPU 70*a* incorporates a built-in timer that counts the ON time t of the sensor 15. The CPU 70*a* compares the output of the timer with a reference to determine whether the output exceeds the threshold value. The reference value is selected to be, for example, T/2 where T is the time required for one complete rotation of the boss 54. If the ON time of the sensor 15 exceeds the reference value, the CPU 70*a* reads a "message for replacement of toner cartridge" from the memory 70*b* and displays the message to indicate to the user that the toner cartridge 17 has only a small amount of toner left therein.

Second Embodiment

A second embodiment differs from the first embodiment in that a sensor lever includes a first lever and a second lever coupled to the first lever through a shaft such that the first lever is pivotal about the shaft.

Figure 19:
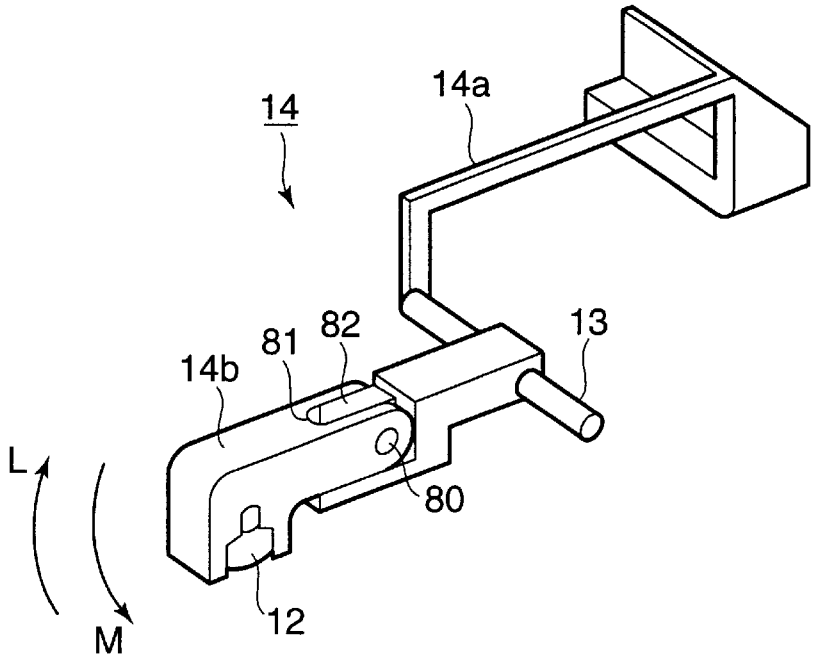
FIG. 19 is a perspective view of a sensor lever.

FIG. 19 is a perspective view of the sensor lever.

Figure 20:
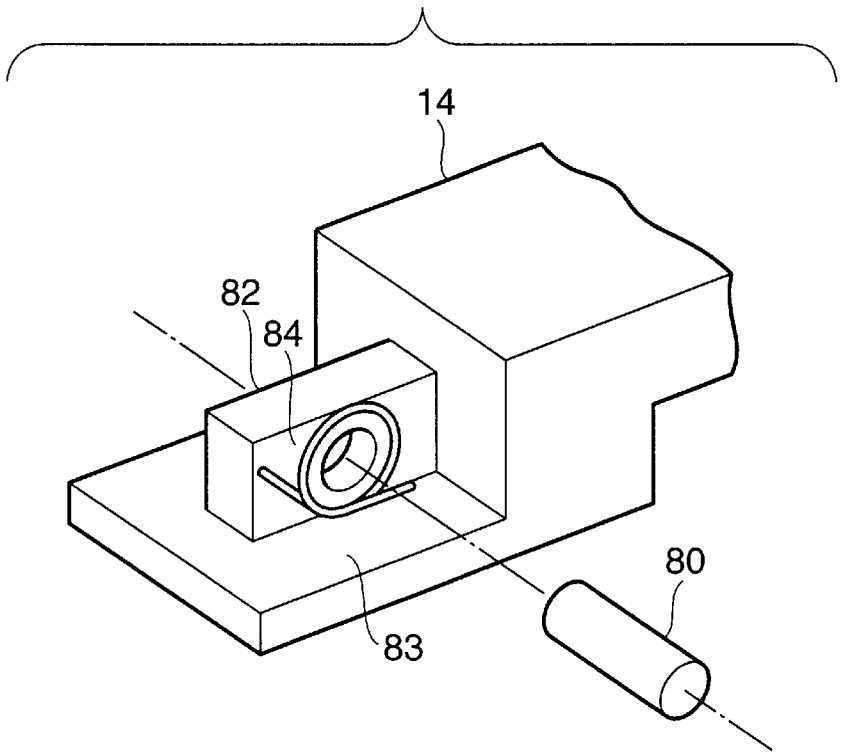
FIG. 20 is a fragmentary perspective view of a second lever of the sensor lever.

FIG. 20 is a fragmentary perspective view of the second lever of the sensor lever.

Referring to FIGS. 19 and 20, the sensor lever 14 includes a first lever 14*a* and a second lever 14*b*. The first and second levers 14*a* and 14*b* are coupled through a shaft 80. A torsion spring 84 (FIG. 20) is loaded between the first and second lever 14*a* and 14*b* so that the second lever 14*b* is urged by a torsion spring 84 in a direction M opposite to the direction shown by arrow L. The second lever 14*b* has a recess 81 formed therein. The first lever 14*a* has a stepped portion 83 and a projection 82 over which the recess 81 of the second lever 14*b* fits such that the second lever 14*b* is pivotal about the shaft 80.

The torsion spring 84 is loaded about the shaft 80 so that the second lever 14*b* is urged in a direction shown by arrow M.

The operation of the second embodiment will be described. It is assumed that unlike the first embodiment, the image forming apparatus 5, 6, 7 and 8 of FIG. 1 are required to move up and down relative to the medium transporting belt 4.

For example, when printing is performed using black toner, the image forming apparatus 8 for black is moved to its down position where the image forming apparatus is close to the medium transporting belt 4. The image forming apparatus 5, 6, and 7, for yellow, magenta, and cyan are moved to their up positions where the image forming apparatus 5, 6, 7 and 8 are away from the medium transporting belt 4. When the image forming apparatus is at its up position, the boss 54 is not driven in rotation, i.e., the remaining toner in the fresh toner chamber is not detected.

For accommodating the up and down movements of the image forming apparatus, the gap between the toner cartridge 17 and the sensor lever 14 should be selected taking into account the vertical stroke of the image forming apparatus when they move between the down position and up position.

In the second embodiment, when, for example, the image forming apparatus 5 is moved to its up position, the top end of the image forming apparatus abuts the second lever 14*b* to push the second lever 14*b* upward, so that the second lever 14*b* pivots in the direction shown by arrow L. This operation of the second lever allows the sensor lever may remain mounted at the same position as the first embodiment while still providing proper toner detecting function when the image forming apparatus is at the down position.

According to the second embodiment, the first lever 14*a* that drives the sensor to become ON and OFF is pivotal relative to the second lever 14*b*. Thus, when the image forming apparatus is moved to its up position, the second lever 14*b* yieldingly pivots about the shaft 80. This construction minimizes the space that accommodates the image forming apparatus in the printer.

Third Embodiment

{Construction}

A third embodiment differs from the first embodiment in that the sensor takes the form of a Hall effect element and the sensor lever is not used.

Figure 21:
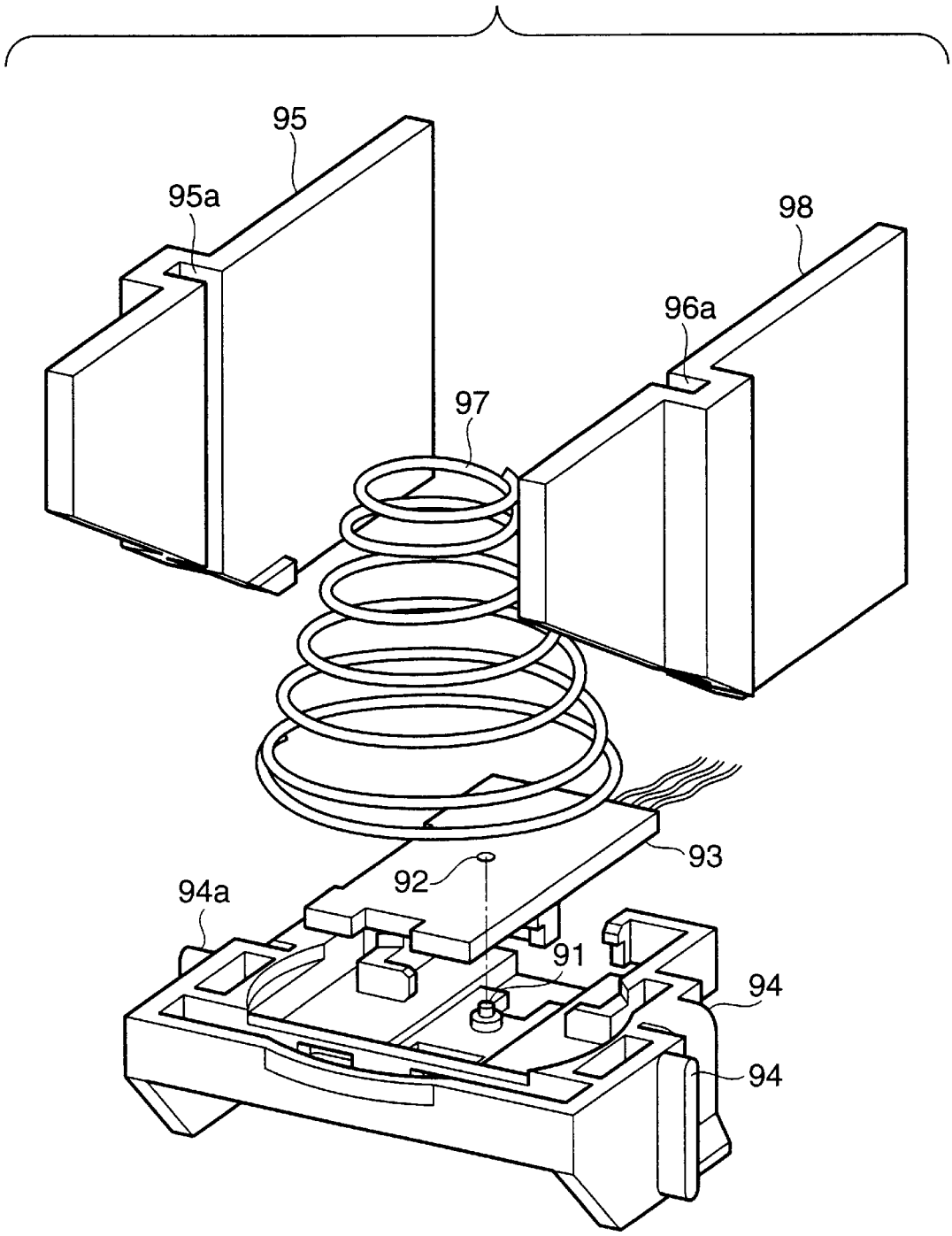
FIG. 21 is an exploded perspective view of a sensor mechanism according to a third embodiment.

FIG. 21 is an exploded perspective view of a sensor mechanism according to the third embodiment.

Figure 22:
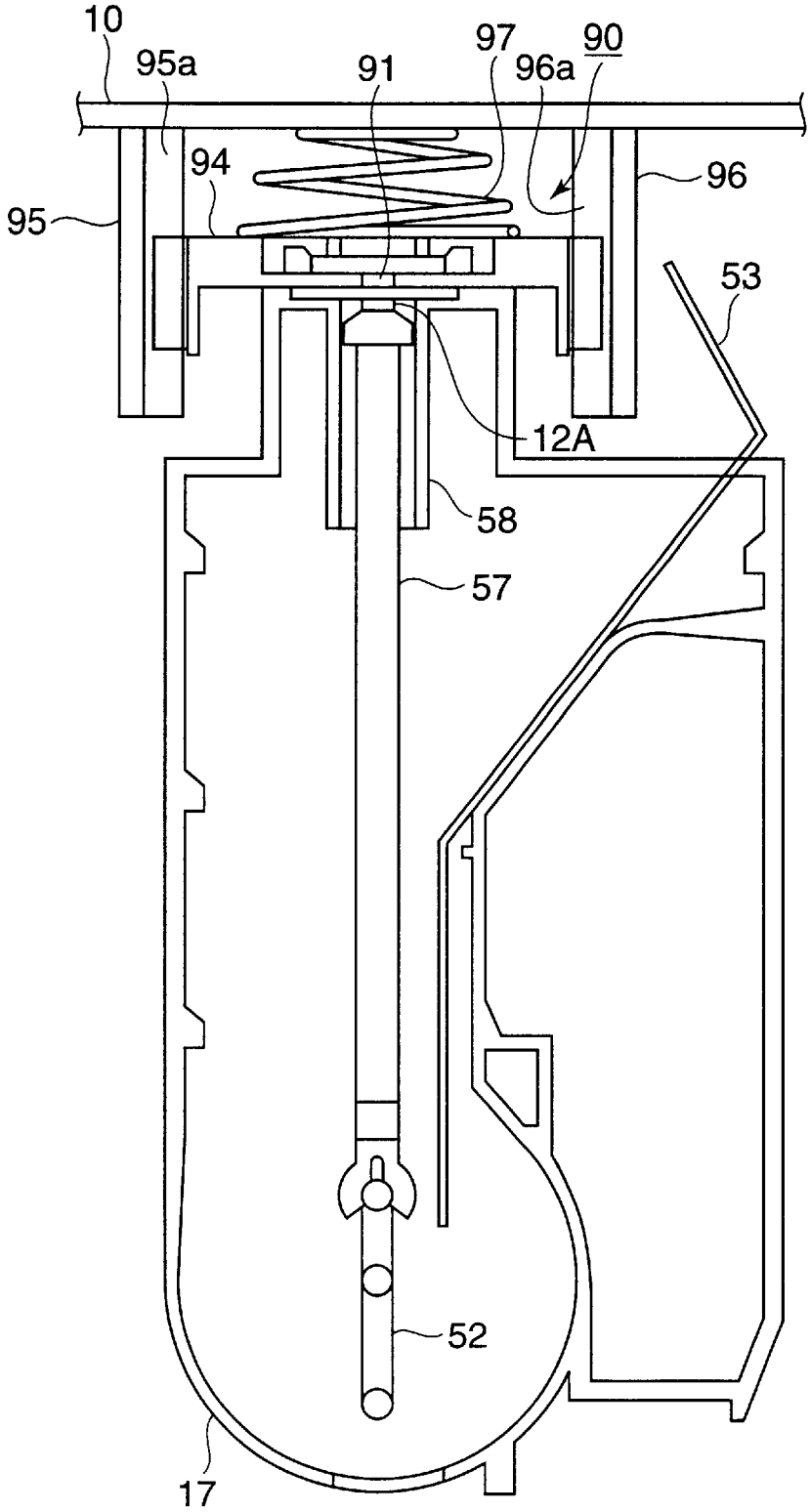
FIG. 22 is a side view, illustrating a remaining-toner detecting mechanism according to the third embodiment when the image forming apparatus is at the down position.

FIG. 22 is a side view illustrating a remaining-toner detecting mechanism according to the third embodiment when the image forming apparatus is at the down position.

Referring to FIGS. 21 and 22, there are provided two vertical walls 95 and 96 that have guide grooves 95a and 96a formed therein, respectively. The walls 95 and 96 are fixed to the lid 10 of the image forming apparatus. A holder 94 has guide projections 94*a* and 94*b* formed on its opposing vertical sides. The guide projections 94*a* and 94*b* loosely fit into the guide grooves 95*a* and 96*a*, respectively, so that the holder 94 is vertically slidable relative to the walls 95 and 96. The holder 94 holds a board 93 that carries a Hall effect element 91 secured in a hole 92. The holder 94 is urged by a coil spring 97 against the top of the toner cartridge 17.

The spring 97 has a top end secured to the inner side of the lid 10 of the electrophotographic recording apparatus 1 and a bottom end secured to the sensor holder 94.

The holder 94 is resiliently urged by the spring 97 against a top wall of the toner cartridge 17 that separates the Hall effect element 91 from one end of the rod 57. It is assumed that unlike the first embodiment, the image forming apparatus is required to move up and down relative to the medium transporting belt 4.

The toner cartridge 17 vertically moves when the image forming apparatus 1 is moved between an up position and a down position. When the image forming apparatus 1 moves to the down position, the holder 94 is resiliently moved downward. When the image forming apparatus 1 moves to the up position, the holder 94 is resiliently moved upward. Thus, regardless of whether the image forming apparatus is at the up position or down position, the Hall effect element 91 is at the same position relative to the toner cartridge 17 at all times.

{Operation}

The operation of the third embodiment will now be described.

When the crank shaft 52 is rotated, the upper free end of the rod 57 moves upward and downward along the guide 58. When the rod 57 moves upward, a permanent magnet 12 attached to the free end of the rod 57 moves close to the Hall effect element 91 so that the Hall effect element 91 becomes ON.

When the rod 57 moves downward, the permanent magnet 12 moves away from the Hall effect element 91 so that the Hall effect element 91 becomes OFF. According to the third embodiment, the permanent magnet 12 can be accurately positioned relative to the Hall effect element 91.

The ON time of the sensor will become longer as the remaining toner is nearing exhaustion. For example, a reference value may be set equal to the length of the ON time of the sensor immediately after the toner cartridge 17 has been replaced by a new, unused one. When the ON time of the sensor becomes longer than the reference value, the CPU 70*a* may display a message that prompts replacement of toner cartridge.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A toner cartridge having an opening through which toner is discharged into a developing unit of an image forming apparatus, the toner cartridge comprising:

a toner chamber that holds the toner therein; and a toner agitating mechanism that is driven to agitate the toner in said toner chamber, said toner agitating mechanism having:

an agitating member that agitates the toner in different ways in accordance with an amount of toner remaining in said toner chamber, and a coupling member that is coupled to the agitating member in such a way that a rotary motion of the agitating member is converted to a reciprocating motion of the coupling member.

2. The toner cartridge according to claim 1, wherein the coupling member has a first end and a second end, the first end being connected to a remaining-toner detecting element; and wherein the agitating member has an agitating element that agitates the toner in the toner chamber and a transmitting element coupled to the second end of the coupling member to transmit the rotary motion of the agitating member to the second end of the coupling member.

3. A toner cartridge having an opening through which toner is discharged into a developing unit of an image forming apparatus, the toner cartridge comprising:

a toner chamber that holds the toner therein; and a toner agitating mechanism that is driven to agitate the toner in said toner chamber, said toner agitating mechanism having an agitating member that agitates the toner in different ways in accordance with an amount of toner remaining in said toner chamber, and a coupling member that is coupled to the agitating member and displaced in accordance with a motion of the agitating member, wherein said agitating member comprises:

a crank shaft that includes a first crank pin that agitates the toner and a second crank pin that is formed in said crank shaft, the crank shaft being rotatably supported in the toner chamber; and wherein the coupling member has a first end rotatably coupled to the second crank pin and a second end slidably inserted in a guide path provided above the toner chamber, the second end having a remaining-toner detecting element provided thereto.

4. The toner cartridge according to claim 3, wherein the remaining-toner detecting element is a magnetic material.

5. The toner cartridge according to claim 3, wherein the remaining-toner detecting element is a permanent magnet.

6. A toner cartridge and an image forming apparatus to which the toner cartridge is detachably attached, the toner cartridge having an opening through which toner is discharged into a developing unit of the image forming apparatus, wherein the toner cartridge comprises a first mechanism having a toner agitating mechanism that is driven to agitate the toner in a toner chamber, the toner agitating mechanism including:

an agitating member that agitates the toner in different ways depending on an amount of toner remaining in the toner chamber; and a coupling member that is coupled to the agitating member in such a way that a rotary motion of the agitating member is converted to a reciprocating motion of the coupling member, said first mechanism further including a remaining toner detecting element that detects an amount of toner remaining in said toner chamber; and wherein the image forming apparatus comprises a second mechanism that detects an operation of the remaining-toner detecting element.

7. The toner cartridge and the image forming apparatus according to claim 6, wherein the coupling member has a first end coupled to the agitating member and a second end to which the remaining-toner detecting element is provided; and wherein said second mechanism comprises:

a sensor lever and a photosensor, the sensor lever operating in response to a movement of said coupling member to cause the photosensor to selectively become ON and OFF.

8. The toner cartridge and the image forming apparatus according to claim 7, wherein said sensor lever has one end to which a magnetic flux-sensitive element is attached, the magnetic flux sensitive element opposing the remaining-toner detecting element at the second end of said coupling member.

9. The toner cartridge and the image forming apparatus according to claim 7, wherein said sensor lever has one end to which a magnet is attached, the magnet opposing the remaining-toner detecting element at the second end of said coupling member.

10. The toner cartridge and the image forming apparatus according to claim 7, wherein said sensor lever includes a first lever and a second lever coupled to the first lever such that the second lever is pivotal relative to the first lever in an upward direction;

wherein the image forming apparatus is vertically movable between an up position and a down position;

wherein when the image forming apparatus is at the down position, said first lever and the second lever cooperate to detect the remaining-toner in the toner chamber; and wherein when the image forming apparatus is at the up position, the image forming apparatus pushes the second lever in the upward direction so that the second lever pivots relative to the first lever not to detect the remaining-toner in the toner chamber.

11. The toner cartridge and the image forming apparatus according to claim 6, wherein said second mechanism includes a Hall effect element.

12. The toner cartridge and the image forming apparatus according to claim 11, wherein the Hall effect element is resiliently urged against a wall of the image forming apparatus that separates the Hall effect element from one end of the remaining toner detecting element;

wherein the toner cartridge is vertically movable between an up position and a down position when the image forming apparatus moves; and wherein when the image forming apparatus moves to the down position, the Hall effect element is resiliently extended in a downward direction to detect the remaining-toner in the toner chamber; and wherein when the image forming apparatus moves to the up position, the Hall effect element is resiliently retracted in the upward direction not to detect the remaining-toner in the toner chamber.

13. The toner cartridge and the image forming apparatus according to claim 6, wherein the agitating member comprises:

a crank shaft that includes a first crank pin that agitates the toner, and a second crank pin formed in said crank shaft, the crank shaft being rotatably supported in said toner chamber;

wherein the coupling member has a first end rotatably coupled to the second crank pin and a second end slidably inserted in a guide path provided above the toner chamber, the second end having the remaining-toner detecting element provided thereto.

14. The toner cartridge and the image forming apparatus according to claim 13, wherein the remaining-toner detecting element is a magnetic flux-sensitive element.

15. The toner cartridge and the image forming apparatus according to claim 13, wherein the remaining-toner detecting element is a permanent magnet.

16. The toner cartridge according to claim 1, wherein the coupling member extends in a longitudinal direction thereof within the toner chamber, and includes a first longitudinal end engaging the agitating member and a second longitudinal end disposed in an upper portion of the toner chamber.

17. The toner cartridge according to claim 16, wherein the toner chamber has a guide path disposed at the upper portion thereof, the second longitudinal end of the coupling member being slidingly disposed in the guide path.

18. The toner cartridge and the image forming apparatus according to claim 6, wherein the coupling member extends within the toner chamber, and includes a first longitudinal end engaging the agitating member and a second longitudinal end disposed in an upper portion of the toner chamber.

19. The toner cartridge and the image forming apparatus according to claim 18, wherein the toner chamber has a guide path disposed at the upper portion thereof, the second longitudinal end of the coupling member being slidingly disposed in the guide path.

* * * * *